US009197978B2

(12) United States Patent
Usami et al.

(10) Patent No.: US 9,197,978 B2
(45) Date of Patent: Nov. 24, 2015

(54) SOUND REPRODUCTION APPARATUS AND SOUND REPRODUCTION METHOD

(75) Inventors: Hikaru Usami, Osaka (JP); Naoya Tanaka, Osaka (JP); Toshihiko Date, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1087 days.

(21) Appl. No.: 13/260,738

(22) PCT Filed: Mar. 25, 2010

(86) PCT No.: PCT/JP2010/002097

§ 371 (c)(1),
(2), (4) Date: Sep. 28, 2011

(87) PCT Pub. No.: WO2010/113434

PCT Pub. Date: Oct. 7, 2010

(65) Prior Publication Data

US 2012/0020481 A1 Jan. 26, 2012

(30) Foreign Application Priority Data

Mar. 31, 2009 (JP) ..... 2009-084551

(51) Int. Cl.
*H04R 1/10* (2006.01)
*H04R 5/00* (2006.01)
(Continued)

(52) U.S. Cl.
CPC ..... *H04S 7/30* (2013.01); *G10L 19/008* (2013.01); *H04R 5/02* (2013.01); *H04S 7/304* (2013.01); *H04R 2205/024* (2013.01); *H04S 3/004* (2013.01); *H04S 7/302* (2013.01)

(58) Field of Classification Search
CPC ..... H04S 3/004; H04S 3/008; H04S 3/02; H04S 7/302; H04S 7/304; H04S 2420/01; H04S 2420/03; H04S 2420/11; H04S 7/30; G10L 19/008; H04R 5/02; H04R 5/023; H04R 2205/024
USPC ..... 381/17, 304, 22, 74
See application file for complete search history.

(56) References Cited

U.S. PATENT DOCUMENTS 3,997,725 A * 12/1976 Gerzon ..... 381/21
5,799,094 A 8/1998 Mouri
(Continued)

FOREIGN PATENT DOCUMENTS

JP 61-219300 9/1986
JP 8-265899 10/1996
(Continued)

*Primary Examiner* — Davetta W Goins
*Assistant Examiner* — Daniel Sellers
(74) *Attorney, Agent, or Firm* — Wenderoth, Lind & Ponack, L.L.P.

(57) ABSTRACT

A sound reproduction apparatus includes a sound source localization estimating unit that performs estimates using input audio signals in an acoustic space when the input audio signals are reproduced by speakers placed in standard positions; and a sound source signal separating unit that calculates a sound source localization signal and separates, from the input audio signals, sound source non-localization signals. Additionally, a sound source position parameter calculating unit calculates parameters indicating a position of the sound source localization signal in the acoustic space; and a reproduction signal generating unit uses the sound source position parameters to distribute the sound source localization signal to front speakers placed in the standard positions in front and headphones placed near the ears of a listener and in positions different from the standard positions, by combining the sound source localization signal and the sound source non-localization signals.

13 Claims, 10 Drawing Sheets

(51) Int. Cl.

| | |
|---|---|
| ***H04R 5/02*** | (2006.01) |
| ***H04S 7/00*** | (2006.01) |
| ***G10L 19/008*** | (2013.01) |
| *H04S 3/00* | (2006.01) |

(56) References Cited

U.S. PATENT DOCUMENTS

| | | | | |
|---|---|---|---|---|
| 6,108,430 | A | 8/2000 | Kurisu | |
| 6,944,309 | B2 | 9/2005 | Terai et al. | |
| 6,990,210 | B2 * | 1/2006 | Cheng | 381/309 |
| 2001/0031062 | A1 | 10/2001 | Terai et al. | |
| 2004/0062401 | A1 | 4/2004 | Davis | |
| 2005/0220309 | A1 * | 10/2005 | Hirata et al. | 381/18 |
| 2005/0276420 | A1 | 12/2005 | Davis | |
| 2007/0195964 | A1 | 8/2007 | Yokota | |
| 2008/0004729 | A1 * | 1/2008 | Hiipakka | 700/94 |
| 2008/0253577 | A1 * | 10/2008 | Eppolito | 381/17 |
| 2008/0292121 | A1 | 11/2008 | Yokota | |
| 2009/0304214 | A1 * | 12/2009 | Xiang et al. | 381/307 |
| 2010/0166191 | A1 * | 7/2010 | Herre et al. | 381/1 |

FOREIGN PATENT DOCUMENTS

| | | | |
|---|---|---|---|
| JP | 8-280100 | | 10/1996 |
| JP | 10-257600 | | 9/1998 |
| JP | 11-220797 | | 8/1999 |
| JP | 2000078699 | A * | 3/2000 |
| JP | 2001-218293 | | 8/2001 |
| JP | 2007-195092 | | 8/2007 |
| JP | 2007-251832 | | 9/2007 |
| JP | 2008-270857 | | 11/2008 |
| WO | 02/063925 | | 8/2002 |
| WO | 2004/019656 | | 3/2004 |

* cited by examiner

FIG. 1 "PRIOR ART"

SOUND REPRODUCTION APPARATUS AND SOUND REPRODUCTION METHOD

TECHNICAL FIELD

The present invention relates to a reproduction technique for multi-channel audio signals.

BACKGROUND OF INVENTION

Background Art

Multi-channel audio signals provided through digital versatile discs (DVD), digital television broadcasting, or the like can be listened to by a listener when an audio signal of each of channels for the multi-channel audio signals is output from a corresponding one of speakers. A space in which a sound that is reproduced from a speaker can be listened to as described above is called an acoustic space.

It is possible to implement sound reproduction with stereophonic perception by outputting, from the speakers placed in predetermined positions in the acoustic space, the audio signals of the respective channels for the multi-channel audio signals. However, limitations of the acoustic space sometimes prevent placement of the speakers in the predetermined positions. In view of this, various sound reproduction methods have been proposed for implementing sound reproduction with stereophonic perception even in such a case.

One of the proposed conventional methods is a method of outputting, from speakers placed in front with respect to a listening position of a listener, audio signals of channels assigned in front with respect to the listening position, while outputting, from headphones near the ears of the listener which are supported by either both of the ears or a head, audio signals assigned behind the listening position. The headphones used in the above method are open-back headphones which allow hearing audio signals output from the headphones and, at the same time, audio signals output from speakers placed in front with respect to the listening position. Similarly, speakers or audio devices placed close to the ears of the listener may be used. As described above, there are sound reproduction methods which allow hearing multi-channel audio signals even in a limited acoustic space in which speakers cannot be placed in the predetermined positions.

An example of conventional sound reproduction methods using above-described configuration is a reproduction apparatus for multidimensional stereophonic sound field described in Patent Literature 1. FIG. 1 is a diagram showing the configuration. The reproduction apparatus for multidimensional stereophonic sound field described by PTL 1 outputs audio signals FL and FR assigned in front with respect to the listening position from speakers 5 and 6 placed in front with respect to the listening position and, at the same time, outputs audio signals SL and SR assigned in back with respect to the listening position from headphones 7 and 8 placed closed to the ears, as described above. In addition, a reproduction signal generating unit performs a desired delay processing, phase adjusting processing, and polarity switching processing on the audio signals SL and SR assigned in back with respect to the listening position, thereby alleviating perceptual phenomenon of localization of a sound image in the head of a listener due to the use of the headphones and increasing a sense of spread around the head of the listener.

CITATION LIST

Patent Literature

[PTL 1]
Japanese Unexamined Patent Application Publication No. 61-219300

SUMMARY OF INVENTION

However, with the reproduction apparatus for multidimensional stereophonic sound field of conventional techniques, only the audio signals assigned behind the listening position are output from headphones placed close to the ears, irrespective of the sound image that is localized in the acoustic space. Therefore, there is a problem that it is difficult to obtain a sense of perspective or a sense of movement in the acoustic space of the sound image, the stereophonic perception such as the sense of spread of the sound field in a front-back direction, and so on, which are obtained by outputting audio signals from speakers placed in predetermined positions in front in and back with respect to the listening position.

In view of the above, an object of the present invention is to provide a sound reproduction apparatus with which the sense of perspective and the sense of movement in the front-back direction and the sense of spread of the sound field in the acoustic space are improved.

In order to solve the above-described problems, a sound reproduction apparatus according to the present invention is a sound reproduction apparatus which reproduces input audio signals using front speakers and ear speakers, the input audio signals being multi-channel and assumed to be reproduced using corresponding speakers placed in predetermined standard positions in an acoustic space, the front speakers being placed in the standard positions in front with respect to a listening position, and the ear speakers being placed near the listening position and in positions different from any of the standard positions, the sound reproduction apparatus comprising: a sound source localization estimating unit configured to estimate, from the input audio signals, whether or not a sound image is localized in the an acoustic space when it is assumed that the input audio signals are reproduced using the speakers placed in the standard positions; a sound source signal separating unit configured to calculate, when the sound source localization estimating unit estimates that the sound image is localized, a sound source localization signal that is a signal indicating the sound image that is localized and to separate, from each of the input audio signals, a sound source non-localization signal that is a signal component which is included in each of the input audio signals and does not contribute to localization of the sound image in the acoustic space; a sound source position parameter calculating unit configured to calculate, from the sound source localization signal, a parameter that indicates a localization position of the sound image indicated by the sound source localization signal; and a reproduction signal generating unit configured to distribute the sound source localization signal to the front speakers and the ear speakers using the parameter that indicates the localization position, and to generate (i) a reproduction signal to be supplied to the front speakers, by combining the sound source localization signal distributed to the front speakers and the sound source non-localization signal separated from each of the input audio signals to be reproduced by the speakers placed in the standard positions in front with respect to the listening position and (ii) a reproduction signal to be supplied to the ear speakers, by combining the sound source localization signal distributed to the ear speakers and the sound source non-localization signal separated from each of the input audio signals to be reproduced by the speakers placed in the standard positions in back with respect to the listening position.

It should be noted that the present invention can be implemented, in addition to implementation as an apparatus, as a method including processing units included in the apparatus as steps, as a program which, when loaded into a computer, allows a computer to execute the steps, as a computer-readable recording medium, such as a CD-ROM, on which the program is recorded, and information, data or a signal which represent the program. In addition, the program, the information, the data, and the signal may be distributed via communication network such as the Internet.

With the configuration described above, the sound reproduction apparatus according to the present invention estimates a sound source localization signal for localizing a sound image in an acoustic space, calculates a sound source position parameter in the acoustic space, and assigns the sound source localization signal based on the sound source position parameter so as to distribute energy to each of channels of the speakers placed in front with respect to a listening position and headphones placed close to the ears, thereby improving the sense of perspective, the sense of movement, and the sense of icy spread of the sound field in the acoustic space not only in a horizontal direction but also in the front-back direction.

According to the configuration described above, although the sound reproduction apparatus according to the present invention is used in a configuration in which speakers and ear speakers such as headphones are arranged in the same manner as in the conventional techniques, the sound reproduction apparatus according to the present invention is capable of generating a reproduction signal which can represent the stereophonic perception not only in the horizontal direction but also in the front-back direction, from a sound image that is localized in an acoustic space

DETAILED DESCRIPTION OF INVENTION

The following explains an embodiment of the present invention.

(Embodiment)

Figure 1:
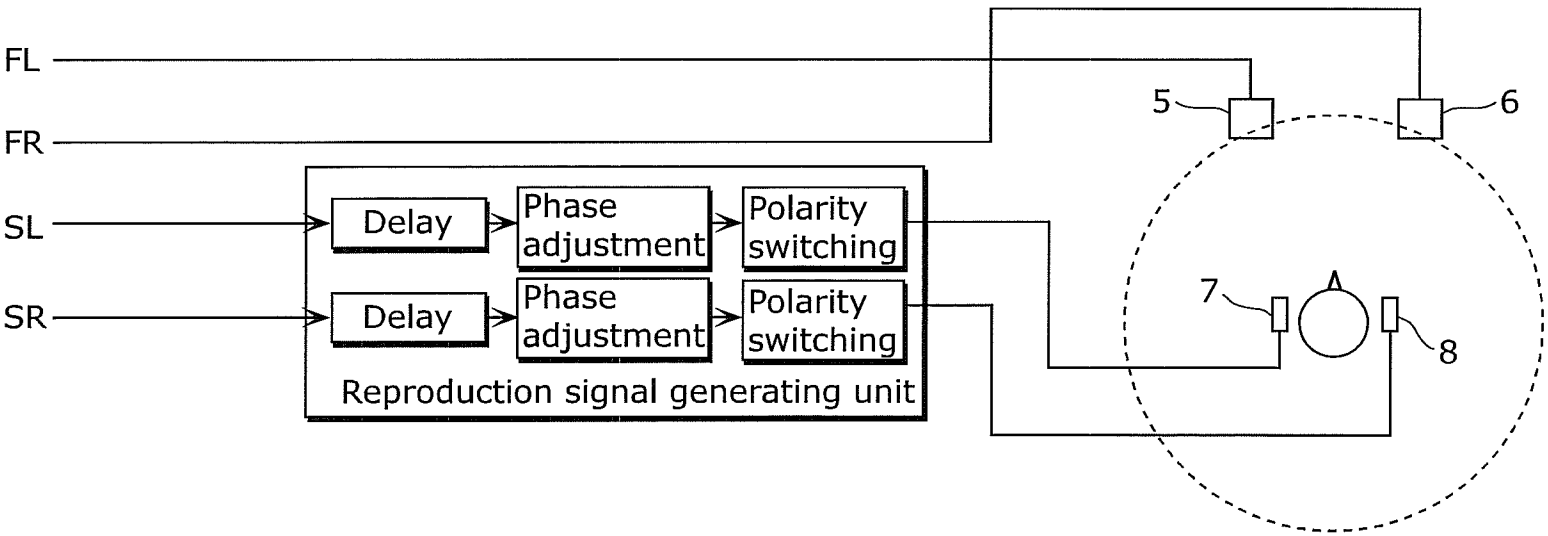
FIG. 1 is a configuration diagram of a conventional sound reproduction apparatus.
Figure 2:
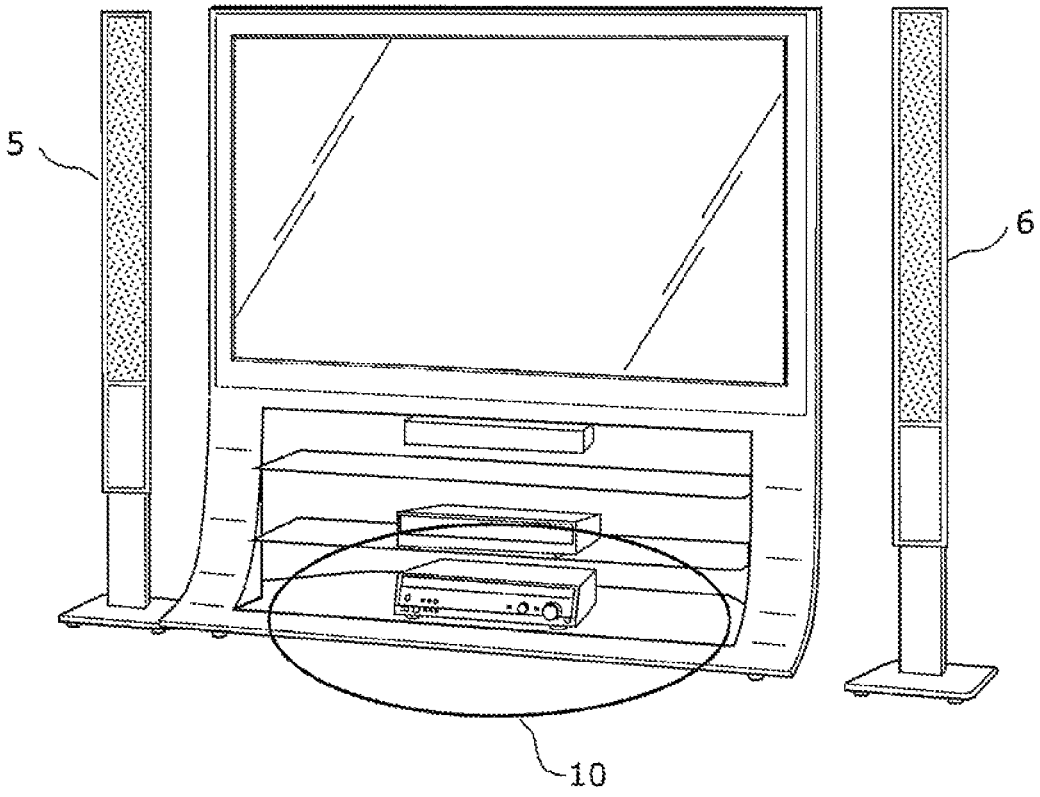
FIG. 2 is a diagram which shows an outline view of a sound reproduction apparatus according to an embodiment of the present invention.
Figure 3:
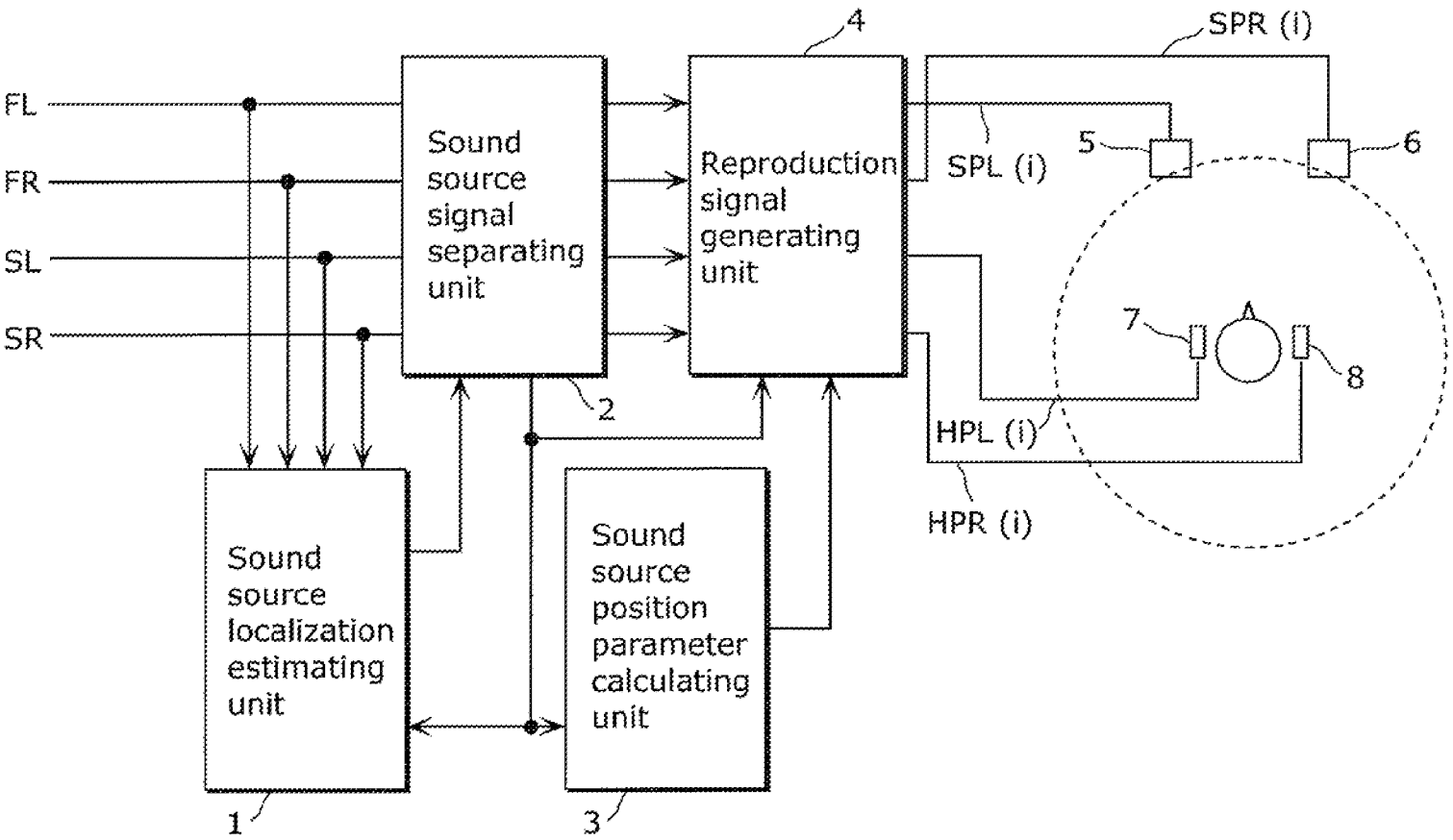
FIG. 3 is a configuration diagram of the sound reproduction apparatus according to the embodiment of the present invention.

FIG. 2 is a diagram which shows an outline view of a sound reproduction apparatus 10 according to an embodiment of the present invention. As shown in FIG. 2, typical examples of the sound reproduction apparatus 10 of the present embodiment are a multi-channel audio amplifier for reproducing multi-channel audio signals, a set-top box which includes a function of the audio amplifier in a DVD system or a TV system for reproducing content including the multi-channel audio signals, or the like. The DVD system or the TV system includes four speakers; that is, a left speaker 5 and a right speaker 6 which are placed in front with respect to a listening position and right and left speakers of a not-illustrated headphone placed near the ears of the listener. The sound reproduction apparatus 10 is an apparatus which reassigns input audio signals assigned to four speakers assumed to be placed in positions determined by standards, to four speakers including front speakers and speakers of a headphone of the above-described DVD system or the TV system, so that the input audio signals are reproduced with the same realistic sensation as in the case where the four speakers are placed in the positions originally assumed; that is, the same sound image is localized. FIG. 3 is a configuration diagram of the sound reproduction apparatus 10 according to the embodiment of the present invention. As shown in FIG. 3, the sound reproduction apparatus 10 includes: a sound source localization estimating unit 1; a sound source signal separating unit 2; a sound source position parameter calculating unit 3; a reproduction signal generating unit 4; a speaker 5; a speaker 6; a headphone 7; and a headphone 8.

In FIG. 3, input audio signals FL, FR, SL, and SR of four channels are input into the sound source localization estimating unit 1 and the sound source signal separating unit 2. The input audio signals are multi-channel audio signals including audio signals for plural channels.

The sound source localization estimating unit 1 estimates, from the in input audio signals FL, FR, SL, and SR of the four channels, a sound source localization signal for localizing a sound image in the acoustic space.

The result of estimating whether or not there is a sound source localization signal by the sound source localization estimating unit 1 is output to the sound source signal separating unit 2 and the sound source position parameter calculating unit 3.

The sound source signal separating unit 2 calculates a signal component of the sound source localization signal from the input audio signals based on the result of the estimation performed by the sound source localization estimating unit 1. In addition, the sound source signal separating unit 2 separates, from the input audio signals, the sound source localization signal and a sound source non-localization signal which does not cause a sound image to be localized.

The sound source position parameter calculating unit 3 calculates, from the sound source localization signal and the sound source non-localization signal separated by the sound source signal separating unit 2, a sound source position parameter that indicates a position of the sound source localization signal in the acoustic space with respect to the listening position. In the following description, a distance from the listening position to the sound source localization signal and an angle between the direction toward the front of the listener and the direction toward the position of the sound source localization signal are used for explaining the sound source position parameter; however, the parameters are not limited to the distance and the angle. Other parameters, such as a vector and a coordinate may be used as long as they can mathematically indicate the position of the sound source localization signal.

The reproduction signal generating unit 4 distributes the sound source in localization signals to the speaker 5 and the speaker 6 which are placed in front with respect to the listening position and the headphone 7 and the headphone 8 which are placed near the ears of the listener, based on the sound source position parameters, and generates a reproduction signal by combining each of the distributed sound source localization signals and a corresponding one of the separated sound source non-localization signals.

The speaker 5 and the speaker 6 are placed right and left in front with respect to the listening position.

The headphone 7 and the headphone 8, which are examples of the ear speaker according to the present invention, are placed right and left near the ears of the listener. It is to be noted that the headphones used here are open-back headphones which allow hearing audio signals output from the headphones and, at the same time, audio signals output from speakers placed in front with respect to the listening position. The ear speaker is a reproduction apparatus which outputs a reproduced sound near the ears of the listener and is not limited to a headphone. The ear speaker may be a speaker placed near the ears of the listener, an audio device, and the like.

The sound reproduction apparatus 10 configured as described above includes: the sound source localization estimating unit 1 which estimates from the input audio signals and the positions of the speakers whether or not a sound image is localized in an acoustic space when it is assumed that all of the input audio signals are reproduced using speakers placed in standard positions; the sound source signal separating unit 2 which separates, from the input audio signals, a sound source localization signal which indicates a sound image localized in the acoustic space and a sound source non-localization signal that is a signal component of the input audio signal which do not contribute to sound source localization in the acoustic space; the sound source position parameter calculating unit 3 which calculates, from sound source localization signal, a parameter of the sound source localization signal which indicates a localization position; and the reproduction signal generating unit 4 which distributes, based on the parameter that indicates the localization position, the sound source localization signal to the speaker 5 and the speaker 6, and to the headphone 7 and the headphone 8 which are examples of the ear speakers and combines the sound source localization signal and the sound source non-localization signal to generate a reproduction signal to be supplied to the speaker 5, the speaker 6, the headphone 7, and the headphone 8.

The following describes an example in which the input audio signals are multi-channel signals and plural channels are subject to input. The plural channels are composed of four channels assigned to right and left in front with respect to the listening position and to right and left in back with respect to the listening position.

The input audio signals are represented as time-series audio signals each of which is provided for a corresponding one of the channels. A signal for the channel extending to the left in front with respect to the listening position is represented as FL(i), a signal for the channel extending to the right is represented as FR(i), a signal for the channel extending to the left in back with respect to the listening position is represented as SL(i), and a signal for the channel extending to the right is represented as SR(i).

In addition, a reproduction signal provided to the speaker 5 placed on the left in front with respect to the listening position is represented as SPL(i), and a reproduction signal provided to the speaker 6 placed on the right in front with respect to the listening position is represented as SPR(i). A reproduction signal provided to the headphone 7 placed in the left near the ears of a listener is represented as HPL(i), and a reproduction signal provided to the headphone 8 placed in the right is represented as HPR(i).

Here, i represents a time-series sample index, processes related to generation of each of the reproduction signals are performed using, as a unit, a frame which includes N samples and which is provided at a predetermined time interval, and the sample index i in the frame is a positive integer where $0 \leq i < N$. In addition, the length of the frame is, for example, 20 milliseconds. It is to be noted that, setting one frame as having the frame length specified by the standards of MPEG-2 AAC, more specifically, as having 1024 samples obtained by sampling with sampling frequency of 44.1 kHz, produces an advantageous effect of reducing a processing load because there is no need to change the unit for signal processing when decoding audio signals which have been coded using MPEG-2 AAC in a stage prior to the sound reproduction apparatus 10 and reproducing the decoded audio signals using the sound reproduction apparatus 10. In addition, in setting the frame length, 256 samples obtained by sampling with sampling frequency of 44.1 kHz may be set as one frame, or a length uniquely specified may be determined as a unit for one frame, depending on the situation.

Figure 4:
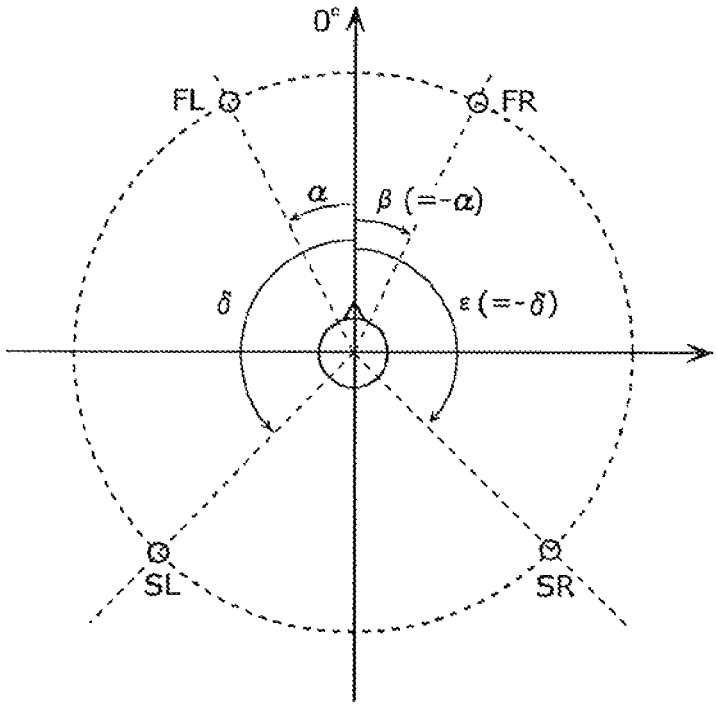
FIG. 4 is an explanation drawing which shows an arrangement for assigning input audio signals in an acoustic space.

FIG. 4 is an explanation drawing which shows an arrangement for assigning the input audio signals for the respective channels as the front being a reference of an angle with respect to the listening position. In FIG. 4, the input audio signals for the respective channels are represented as FL, FR, SL, and SR and angles with respect to the reference of an angle that is the front with respect to the listening position are represented as $\alpha$, $\beta$, $\delta$, and $\epsilon$. In a general reproduction environment, the audio signal FL and the audio signal FR of the channels which make a pair and the signal SL and the signal SR of the channels which make a pair, among the input audio signals, are arranged symmetrically with respect to a symmetrical axis that is a line extending in the direction of the reference of an angle. Thus, β is an angle same as (−α) and ϵ is an angle same as (−δ).

The following explains in detail an operation performed by the sound reproduction apparatus 10 according to an embodiment of the present invention.

The sound source localization estimating unit 1 estimates, from the audio signals of two channels which make a pair among the multi-channel input audio signals, a sound source localization signal for localizing a sound image in an acoustic space.

As an example of the above-described operation, the following describes a case where a sound source localization signal X(i) is estimated from the audio signal FL(i) and the audio signal FR(i) which are audio signals assigned right and left in front with respect to the listening position and which are for the channels which make a pair.

When there is a signal component having a high correlation between two channels of the audio signals, a sound image to be localized by the two audio signals in the acoustic space is perceived. The sound source localization estimating unit 1 calculates, from Expression 1, a correlation coefficient C1 that indicates a correlation between the time-series audio signal FL (i) and audio signal FR(i). Next, the sound source localization estimating unit 1 compares a value of the calculated correlation coefficient C1 with a predetermined threshold TH1, and determines that there is a sound source localization signal in the case where the correlation coefficient C1 exceeds the threshold TH1. Conversely, the sound source localization estimating unit 1 determines that there is not a sound source localization signal in the case where the correlation coefficient C1 is equal to or lower than the threshold TH1.

Here, the correlation coefficient C1 calculated by Expression 1 is a value within a range indicated by Expression 2. The audio signal FL(i) and the audio signal FR(i) are the most highly correlated when the correlation coefficient C1 is 1, and the audio signal FL(i) and the audio signal FR(i) are the same signals in phase. In addition, as the correlation coefficient C1 becomes smaller toward 0, the correlation between the audio signal FL(i) and the audio signal FR(i) becomes lower. When the correlation coefficient C1 is 0, there is no correlation between the audio signal FL(i) and the audio signal FR(i).

As a method of estimating the sound source localization signal X(i), a predetermined threshold TH1 which is set so as to satisfy the condition shown by Expression 3 and the correlation coefficient C1 calculated by Expression 1 are compared, thereby performing the determination. It is to be noted that, in the case where the correlation coefficient C1 is a negative value, the correlation between the audio signal FL(i) and the audio signal FR(i) is low when the value is close to 0, as in the case of a positive value, and thus it is determined that there is no sound source localization signal. As the correlation coefficient C1 approaches −1, an inverse correlation increases between the audio signal FL(i) and the audio signal FR(i). When the correlation coefficient C1 is −1, the phases of the audio signal FL(i) and the audio signal FR(i) are inverted, indicating that the audio signal FL(i) is an inverse phase audio signal (−FR(i)) of the audio signal FR(i). However, the condition that a pair of signals has phases opposite to each other as described above is very rare in general. The sound source localization estimating unit 1 in the sound reproduction apparatus 10 according to the embodiment of the present invention determines that there is no inverse phase sound source localization signal.

[Math. 1]

$$C1 = \frac{\sum_{i=0}^{N-1} \{FL(i) \times FR(i)\}}{\sqrt{\sum_{i=0}^{N-1} \{FL(i) \times FL(i)\}} \times \sqrt{\sum_{i=0}^{N-1} \{FR(i) \times FR(i)}} \quad \text{(Expression 1)}$$

[Math. 2]

$$-1 \leq C1 \leq 1 \quad \text{(Expression 2)}$$

[Math. 3]

$$0 < TH1 < 1 \quad \text{(Expression 3)}$$

Figure 5:
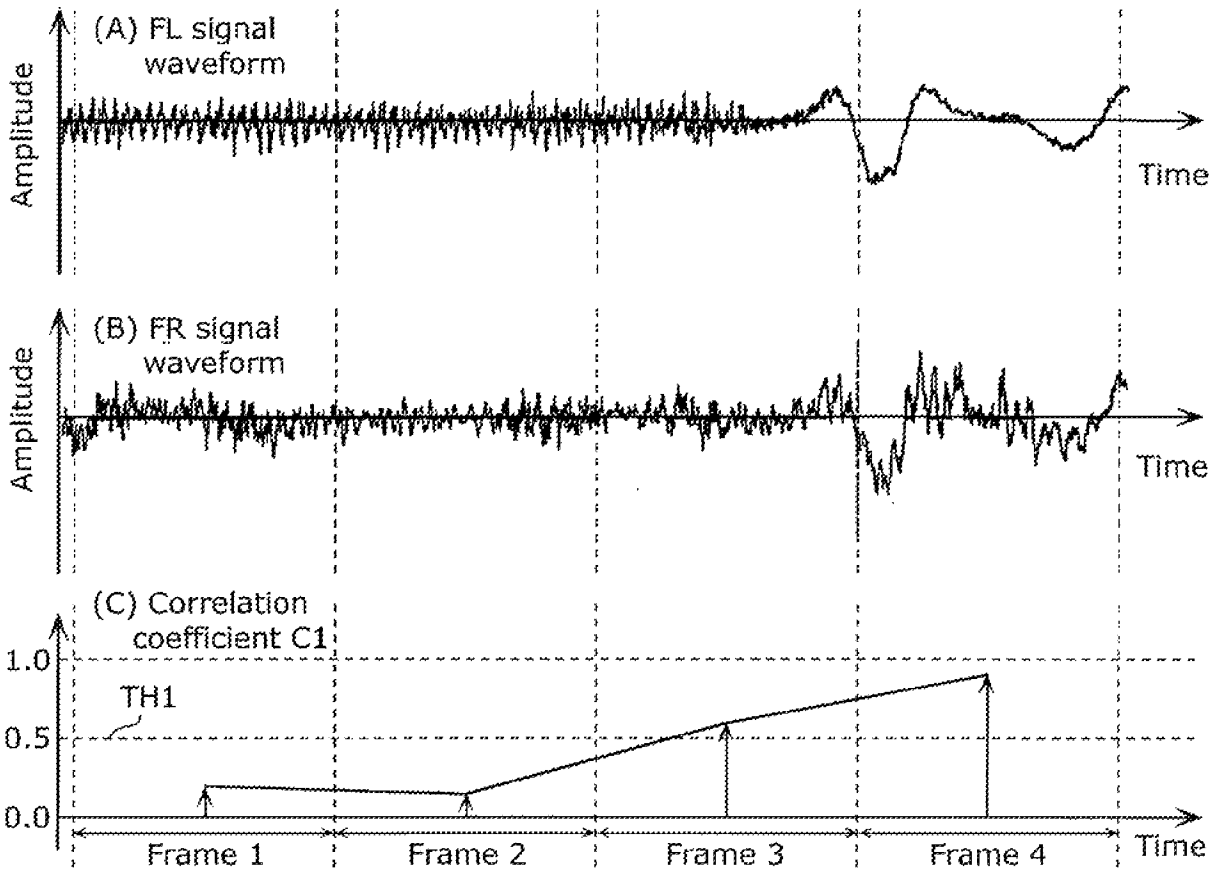
FIG. 5 is an explanation drawing of: a correlation coefficient C1 calculated from audio signals FL(i) and FR(i) by a sound source localization estimating unit 1; and an operation of determining whether or not a sound source localization signal X(i) is present.

FIG. 5 is an explanation drawing which shows an operation of determining whether or not a sound source localization signal X(i) is present, based on a value of the correlation coefficient C1 calculated from the audio signal FL(i) and the audio signal FR(i) and comparison between the calculated correlation coefficient. C1 and the threshold TH1.

(A) in FIG. 5 shows a time-series signal waveform of the audio signal FL(i) and (B) in FIG. 5 shows a time-series signal waveform of the audio signal FR(i). Time is shown in the horizontal axis and signal amplitude is shown in the vertical axis.

In addition, (C) in FIG. 5 shows a value of the correlation coefficient C1 calculated for each of the frames by the sound source localization estimating unit 1 using Expression 1. Time axis is shown in the horizontal axis and a value of the calculated correlation coefficient C1 is shown in the vertical axis.

In the embodiment according to the present invention, the threshold TH1 for determining whether or not a sound source localization signal is present is 0.5. A position at which the threshold TH1 is 0.5 is shown by broken lines in (C) in FIG. 5.

In the example shown in FIG. 5, since the correlation coefficient C1 is below the threshold TH1 in the frame 1 and the frame 2, it is determined that a sound source localization signal X(i) is not present. Since the correlation coefficient C1 exceeds the threshold TH1 in the frame 3 and the frame 3, it is determined that a sound source localization signal X(i) is present.

However, when one of the channels of the audio signals which make a pair is 0, or when the energy of one of the channels is sufficiently larger than the other, a sound image is perceived which is localized in the acoustic space by only one of the channels. In view of the above, as shown in Expression 4, when the audio signal FL(i) is 0 and the audio signal FR(i) is not 0, or when the audio signal FR(i) is 0 and the audio signal FL(i) is not 0, the audio signal FL(i) or the audio signal FR(i) for a channel which is not 0 can be regarded as a sound source localization signal X(i), and thus it is determined that a sound source localization signal X(i) is present.

[Math. 4]

$$\begin{cases} (FL(i) = 0) \text{ and } (FR(i) \neq 0) \\ \quad \text{or} \\ (FL(i) \neq 0) \text{ and } (FR(i) = 0) \end{cases} \quad \text{(Expression4)}$$

In addition, as shown in Expression 5, when the energy of one of the audio signal FL(i) and the audio signal FR(i) is sufficiently larger than the other, the audio signal with larger energy can be regarded as a sound source localization signal X(i), and thus it is determined that a sound source localization signal X(i) is present. When TH2 is set to 0.001, for example, since an energy difference is represented by (−201 og (TH2)), it is indicated that there is the energy difference of 60 [dB] or larger between the audio signal FL(i) and the audio signal FR(i) in Expression 5.

(Expression 5)

$$\begin{cases} \sum_{i=0}^{N-1} |FL(i)|^2 > TH2 \times \left( \sum_{i=0}^{N-1} |FR(i)|^2 \right) \\ \text{or} \\ \sum_{i=0}^{N-1} |FR(i)^2| > TH2 \times \left( \sum_{i=0}^{N-1} |FL(i)|^2 \right) \end{cases} \quad \text{[Math. 5]}$$

As described above, the sound source localization estimating unit 1 may estimate a sound source localization signal from the audio signals of two channels which make a pair among the input audio signals.

The following describes an operation of the sound source signal separating unit 2.

The sound source signal separating unit 2, when the sound source localization estimating unit 1 determines that a sound source localization signal is present, calculates a signal component of the sound source localization signal included in an audio signal of each of the channels which is included in the input audio signals, and separates a sound source non-localization signal which does not cause a sound image to be localized in the acoustic space.

The case where signal components X0 (*i*) an X1 (*i*) of a sound source localization signal X(i) included in the audio signal FL(i) and the audio signal FR(i) are calculated and sound source non-localization signals FLa(i) and FRa(i) are separated is shown as an example.

Here, among the components of the sound source localization signal X(i), the component in the direction of an angle of the audio signal FL(i) is a signal component X0 (*i*), and the component in the direction of an angle of the audio signal FR(i) is a signal component X1 (*i*).

Here, when the sound source localization estimating unit 1 determines that a sound image is localized in the acoustic space, it is indicated that the correlation between the two audio signals are high and signal components in phase are included. Signals in phase of two audio signals are generally obtained by a sum signal ((FL(i)+FR(i))/2), and thus when a constant is a, the in-phase signal component X0 (*i*) included in the audio signal FL(i) is represented by Expression 6.

(Expression 6)

$$X0(i) = a \times \left( \frac{FL(i) + FR(i)}{2} \right) \quad \text{[Math. 6]}$$

For example, a constant a is calculated such that a sum Δ(L) of residual errors between a sum signal ((FL(i)+FR(i))/2) indicating a signal component in phase with the audio signal FL(i) and the audio signal FR(i) represented by Expression 7 and the audio signal FL(i) is minimized. Then the signal component X0 (*i*) represented by Expression 6 is determined using the constant a.

(Expression 7)

$$\Delta(L) = \sum_{i=0}^{N-1} \left( FL(i) - a \times \left( \frac{FL(i) + FR(i)}{2} \right) \right)^2 \quad \text{[Math. 7]}$$

Further, based on an energy ratio of the audio signal FL(i) to the signal component X0 (*i*), a signal FLa(i) represented by Expression 8, for example, is separated as a sound source non-localization signal which does not cause a sound image to be localized in the acoustic space.

(Expression 8)

$$FL_a(i) = \left( 1 - \frac{\sum_{j=0}^{N-1} (X0(j))^2}{\sum_{j=0}^{N-1} (FL(j))^2} \right) \times (FL(i) - X0(i)) \quad \text{[Math. 8]}$$

Likewise, as to a signal component X1 (*i*) of the sound source localization signal X(i) included in the audio signal FR(i), it is possible to separate a sound source non-localization signal FRb(i) by minimizing the sum of residual errors between a sum signal ((FL(i)+FR(i))/2) and the audio signal FR(i), based on an energy ratio of the audio signal FR(i) to the signal component X1 (*i*). More specifically, when the constant is b, the signal component X1 (*i*) in phase included in the audio signal FR(i) is represented by Expression 9. A value of the constant b is calculated from Expression 10 such that the sum Δ(R) of residual errors between a sum signal ((FL(i)+FR(i))/2) and the audio signal FR(i) is minimized. The sound source non-localization signal FRb(i) is separated from the audio signal FR(i) based on the energy ratio of the audio signal FR(i) to the signal component X1 (*i*), as indicated by Expression 11.

(Expression 9)

$$X1(i) = b \times \left( \frac{FL(i) + FR(i)}{2} \right) \quad \text{[Math. 9]}$$

(Expression 10)

$$\Delta(R) = \sum_{i=0}^{N-1} \left( FR(i) - b \times \left( \frac{FL(i) - FR(i)}{2} \right) \right)^2 \quad \text{[Math. 10]}$$

(Expression 11)

$$FR_b(i) = \left( 1 - \frac{\sum_{j=0}^{N-1} (X1(j))^2}{\sum_{j=0}^{N-1} (FR(j))^2} \right) \times (FR(i) - X1(i)) \quad \text{[Math. 11]}$$

The relationship in the acoustic space between the signal components X0 (*i*) and X1 (*i*) of the sound source localization signal X(i) calculated as described above is shown in FIG. 6.

Figure 6:
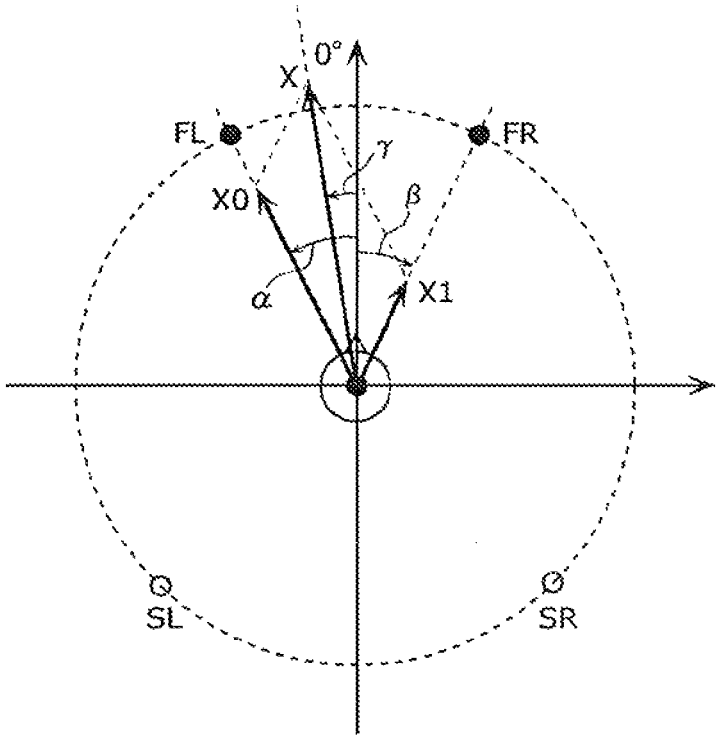
FIG. 6 is an explanation drawing which shows a relationship between the sound source localization signal X(i), a signal component X0(*i*), and a signal component X1(*i*) which are estimated from the input audio signals FL(i) and FR(i).

In FIG. 6, FL and FR indicate a direction of the audio signal FL(i) and a direction of the audio signal FR(i), respectively, which are assigned in the acoustic space. The audio signal FL is assigned at an angle α on the left and the audio signal FR is assigned at an angle β on the right as the front with respect to the listening position being a reference of an angle. X0 and X1 represent vectors that have magnitudes of energy of the signal components X0 (*i*) and the X1 (*i*), respectively, and indicate directions of arrival of the signal components X0 (*i*) and the X1 (*i*), respectively, viewed from a listening position. It is to be noted that, since the signal components X0 (*i*) and X1 (*i*) of the sound source localization signal X(i) are signal components included in the audio signals FL(i) and FR(i), respectively, the angles of the signal component X0 and the signal component X1 are the same as the angles of the audio signal FL and the audio signal FR, respectively.

As described above, the sound source signal separating unit 2 may separate the sound source non-localization signal by minimizing a square sum of an error between a sum signal of the audio signals FL(i) and FR(i) of two channels which make a pair and one audio signal FL(i) of the pair. The sound source signal separating unit 2 may separate the sound source non-localization signal by minimizing a square sum of an error between a sum signal of the audio signals FL(i) and FR(i) and the audio signal FR(i).

The following describes an operation of the sound source position parameter calculating unit 3.

The sound source position parameter calculating unit 3, based on the signal component of the sound source localization signal separated by the sound source signal separating unit 2, calculates (i) an angle of a directional vector that indicates a direction of arrival of the sound source localization signal and (ii) energy for deriving a distance from the listening position and the sound source localization signal, as sound source position parameters which indicate the position of the sound source localization signal.

The direction of arrival of the sound source localization signal X(i) is obtained by composition of vectors using an angle of aperture of each of the vectors X0 and X1 which indicate two signal components shown in FIG. 6 and the respective signal amplitudes, and thus a relational expression of Expression 12 is satisfied when the angle that indicates the direction of arrival of the vector X indicating the sound source localization signal X(i) is γ.

(Expression 12)

$$\gamma = \arctan\left(\frac{|X0| \times \sin\alpha + |X1| \times \sin\beta}{|X0| \times \cos\alpha + |X1| \times \cos\beta}\right) \quad \text{[Math. 12]}$$

It is to be noted that, when FL and FR are placed at the same angle on right and left with respect to the front of the listing position; that is, when β is (−α), it is possible to represent Expression 12 as Expression 13.

(Expression 13)

$$\gamma = \arctan\left(\frac{(|X0| + |X1|) \times \sin\alpha}{(|X0| + |X1|) \times \cos\alpha}\right) \quad \text{[Math. 13]}$$

Expression 13 shows that, when the signal amplitude of the signal component X0 is larger than the signal amplitude of the signal component X1, γ is a positive value and a sound image is localized in the direction near the speaker 5 placed on the left in front with respect to the listening position. Conversely, when the signal amplitude of the signal component X1 is larger than the signal amplitude of the signal component X0, γ is a negative value and a sound image is localized in the direction near the speaker 6 placed on the right in front with respect to the listening position. In addition, when the signal amplitude of the signal component X0 and the signal component X1 is the same, γ is 0 and a sound image is localized in the direction of the front of the listening position at the same distance from the two speakers placed right and left in front with respect to the listening position.

In addition, the sound source localization signal X(i) is a composition of the signal component X0 (*i*) and the signal component X1 (*i*) which are in phase and included in the audio signal FL and the audio signal FR, respectively, as described in the operations of the sound source localization estimating unit 1 and the sound source signal separating unit 2, and a relationship based on the energy conservation law is satisfied as shown in Expression 14. This makes it possible to calculate energy L of the sound source localization signal X(i) using Expression 14.

(Expression 14)

$$L = \sum_{i=0}^{N-1} |X(i)|^2 = \left(\sum_{i=0}^{N-1} |X0(i)|^2 + \sum_{i=0}^{N-1} |X1(i)|^2\right) \quad \text{[Math. 14]}$$

The following describes the relationship between the energy of the sound source localization signal X(i) and the distance between the listening position and the sound source localization signal X(i). Here, when it is assumed, for example, that the sound source localization signal is a sufficiently small point sound source, a relational expression of Expression 15 is satisfied between a distance from the point sound source to the listening position and energy. In Expression 15, R0 denotes a reference distance from the point sound source, R denotes a distance from the point sound source to another listening position, L0 denotes energy at a position distant by the reference distance, and L denotes energy of the sound source localization signal at the listening position.

(Expression 15)

$$L = L0 - 20 \times \log10\left(\frac{R}{R0}\right) \quad \text{[Math. 15]}$$

When Expression 15 is applied with one of two different point sound sources when the listening position is fixed being the reference distance R0 and the distance to the other listening position being R, it is possible to calculate the distance R that is a distance from the listening position to the localization position of the sound source localization signal X(i) based on the energy L, by setting, as being predetermined constants, the reference distance R0 from the listening position and the energy L0 in the reference distance. Here, it is assumed, for example, that the reference distance R0 from the listening position is 1.0 [m] and the energy in the reference distance is −20 [dB].

As described above, the sound source position parameter calculating unit 3 calculates the angle γ which indicates the direction of arrival of the sound source localization signal X(i) and the distance R from the listening position to the sound source localization signal X(i), as parameters that indicate the position of the sound source localization signal X(i).

It is to be noted that, in the above-described operations of the sound source localization estimating unit 1, the sound source signal separating unit 2, and the sound source position parameter calculating unit 3, the sound source localization signal X(i) is estimated from the audio signals FL(i) and the FR(i), the signal components X0(*i*) and X1(*i*) are calculated, the sound source non-localization signals FLa(i) and FRb(i) are separated, and the sound source position parameter of the sound source localization signal X(i) is calculated; however, it is possible to perform in the same manner the estimation of the sound source localization signal, the calculation of the signal components, the separation of the sound source non-localization signal, and the calculation of the sound source position parameter, with any other combinations of channels of the multi-channel input audio signals.

More specifically, the sound source localization estimating unit 1 determines whether or not a sound image is localized from the audio signals SL(i) and SR(i), estimates the sound source localization signal Y (i) for each of the frames in which a sound image is localized, and separates sound source non-localization signals Sla(i) and SRb(i). To be more specific, it is possible to estimate the sound source localization signal Y(i), calculate the signal components Y0(*i*) and Y1(*i*), and separate the sound source non-localization signals SLa(i) and SRb(i) in the same manner as the method that has already been described for the above-described audio signals FL(i) and FR(i), by appropriately substituting each of the variables in each of the expressions in the above-described Expression 1 to Expression 14.

In the following description, the audio signal FL(i) is substituted with an audio signal SL(i), the audio signal FR(i) is substituted with an audio signal SR(i), the sound source localization signal X(i) is substituted with a sound source localization signal Y(i), the signal component X0(*i*) is substituted with a signal component Y0(*i*), the signal component X1(*i*) is substituted with a signal component Y1(*i*), the angle α is substituted with an angle δ, the angle β is substituted with an angle ϵ, the angle γ is substituted with an angle λ, the sound source non-localization signal FLa(i) is substituted with a sound source non-localization signal SLa(i), and the sound source L5 non-localization signal FRb is substituted with a sound source non-localization signal SRb(i), in each of the expressions of Expression 1 to Expression 14. With this, Expression 16 to Expression 27 described below are obtained.

(Expression 16)

$$C1 = \frac{\sum_{i=0}^{N-1} \{SL(i) \times SR(i)\}}{\sqrt{\sum_{i=0}^{N-1} \{SL(i) \times SL(i)\}} \times \sqrt{\sum_{i=0}^{N-1} \{SR(i) \times SR(i)\}}} \quad \text{[Math. 16]}$$

First, the sound source localization estimating unit 1 calculates a correlation coefficient C1 which indicates the correlation between the audio signals SL(i) and SR(i) for each of the frames, using Expression 16. Then the sound source localization estimating unit 1 checks whether or not the calculated correlation coefficient C1 exceeds the threshold TH1 and determines that a sound source localization signal Y(i) is present in a frame in which the correlation coefficient C1 exceeds the threshold TH1. When the sound source localization estimating unit 1 determines that the sound source localization signal Y(i) is present, the sound source signal separating unit 2 calculates a constant a which minimizes a value of Δ(L), using Expression 18. Next, the calculated a is substituted into Expression 17 and a signal component Y0(*i*) included in the audio signal SL(i) of the sound source localization signal Y(i) is calculated.

(Expression 17)

$$Y0(i) = a \times \left(\frac{SL(i) + SR(i)}{2}\right) \quad \text{[Math. 17]}$$

(Expression 18)

$$\Delta(L) = \sum_{i=0}^{N-1} \left(SL(i) - a \times \left(\frac{SL(i) + SR(i)}{2}\right)\right)^2 \quad \text{[Math. 18]}$$

Furthermore, the sound source signal separating unit 2 applies the calculated signal component Y0(*i*) and the audio signal SL(i) into Expression 19 to calculate, and separate from the audio signal SL(i), a sound source non-localization signal SLa(i).

(Expression 19)

$$SL_a(i) = \left(1 - \frac{\sum_{j=0}^{N-1} (Y0(j))^2}{\sum_{j=0}^{N-1} (SL(j))^2}\right) \times (SL(i) - Y0(i)) \quad \text{[Math. 19]}$$

Likewise, the sound source signal separating unit 2 calculates a constant b which minimizes a value of Δ(R), using Expression 21. Next, the calculated b is substituted into Expression 20 and a signal component Y1(*i*) included in the audio signal SR(i) of the sound source localization signal Y(i) is calculated.

(Expression 20)

$$Y1(i) = b \times \left(\frac{SL(i) + SR(i)}{2}\right) \quad \text{[Math. 20]}$$

(Expression 21)

$$\Delta(R) = \sum_{i=0}^{N-1} \left(SR(i) - b \times \left(\frac{SL(i) + SR(i)}{2}\right)\right)^2 \quad \text{[Math. 21]}$$

The sound source signal separating unit 2 applies the calculated signal component Y1(*i*) and the audio signal SR(i) into Expression 22 to calculate, and separate from the audio signal SR(i), a sound source non-localization signal SRb(i).

(Expression 22)

$$SR_b(i) = \left(1 - \frac{\sum_{j=0}^{N-1} (Y1(j))^2}{\sum_{j=0}^{N-1} (SR(j))^2}\right) \times (SR(i) - Y1(i)) \quad \text{[Math. 22]}$$

Figure 7:
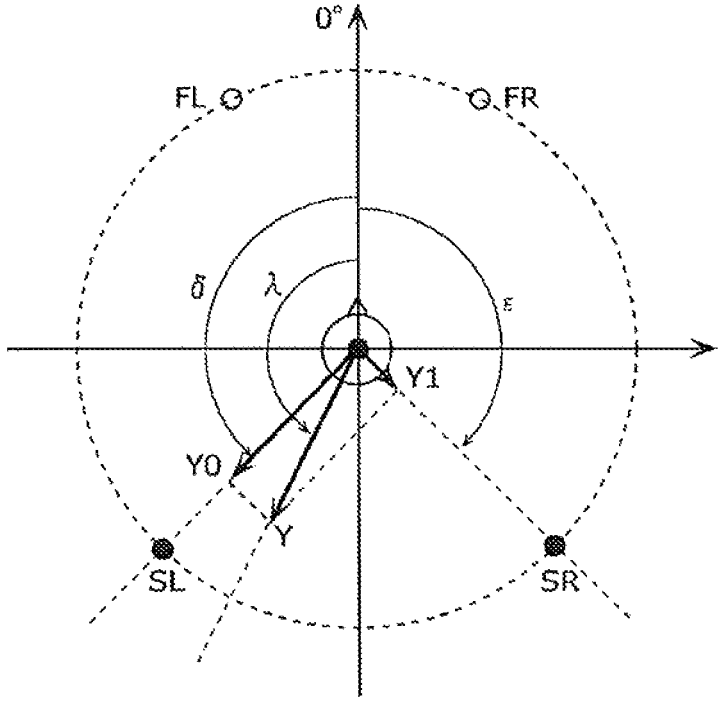
FIG. 7 is an explanation drawing which shows a relationship between the sound source localization signal Y(i), a signal component Y0(*i*), and a signal component Y1(*i*) which are estimated from the input audio signals SL(i) and SR(i).

FIG. 7 is an explanation drawing which shows the relationship between the sound source localization signal Y(i) and the signal is components Y0(*i*) and Y1(*i*) in the acoustic space when the sound source localization signal Y(i) is estimated from the audio signals SL(i) and SR(i) assigned to speakers placed at predetermined positions to right and left in back with respect to the listening position, and the signal components Y0(*i*) and Y1(*i*) are calculated by the sound source signal separating unit 2.

In FIG. 7, SL and SR indicate directions, from the listening position, of the audio signals SL(i) and SR(i) which are assigned in the acoustic space. With the front with respect to the listening position being a reference of an angle, SL is assigned at the angle δ to left and SR is assigned at the angle ϵ to right. Y0 and Y1 represent vectors that have magnitudes of energy of the signal components Y0(*i*) and the Y1(*i*), respectively, and indicate directions of arrival of the signal components Y0(*i*) and the Y1(*i*), respectively. In addition, a vector Y that indicates the direction of arrival of the sound source localization signal Y (i) is obtained by combining the vectors of the signal components Y0 and Y1. An angle that indicates the direction of arrival of the vector Y is indicated by λ. With this, the sound source position parameters of the sound source localization signal Y (i) that is localized in the acoustic space by the audio signals SL(i) and SR(i) is in calculated.

The sound source position parameter calculating unit 3 calculates, as a parameter that indicates the position of the sound source localization signal Y, the angle λ that indicates the direction of arrival of the sound source localization signal Y with respect to the listening position, based on the energy Y0 and the energy Y1 of the signal components of the sound source localization signal and the angles δ and ϵ that indicate the directions of arrival. The angle λ is calculated using Expression 23.

(Expression 23)

[Math. 23]

$$\lambda = \arctan\left(\frac{|Y0| \times \sin\delta + |Y1|\sin\varepsilon}{|Y0| \times \cos\delta + |Y1| \times \cos\varepsilon}\right)$$

In Expression 23, since the equation δ=−ϵ is satisfied between the angles δ and ϵ in the same manner as in the angles α and β, Expression 23 can be represented as Expression 24.

[Math. 24]

$$\lambda = \arctan\left(\frac{(|Y0| - |Y1|) \times \sin\delta}{(|Y0| + |Y1|) \times \cos\delta}\right) \quad \text{(Expression 24)}$$

The sound source localization signal Y (i) is a composition of the signal component Y0(*i*) and the signal component Y1(*i*) which are included in the audio signal SL and the audio signal SR and a relationship based on the energy conservation law is satisfied as shown in Expression 25. This makes it possible to calculate energy L of the sound source localization signal Y(i), using Expression 25.

[Math. 25]

$$L = \sum_{i=0}^{N-1} |Y(i)|^2 = \left(\sum_{i=0}^{N-1} |Y0(i)|^2 + \sum_{i=0}^{N-1} |Y1(i)|^2\right) \quad \text{(Expression 25)}$$

Furthermore, the distance R from the listening position to the sound source localization signal Y can be calculated by substituting the calculated energy L into Expression 15 and the above-described initial values into L0 and R0.

In addition, even when the correlation coefficient C1 does not exceed the threshold TH1 in the determination performed by the sound source localization estimating unit 1, Expression 26 and Expression 27 are further used to determine whether or not one of the channels of the audio signals SL(i) and SR(i) is 0, or the energy of one of the channels is sufficiently larger than the other. When the audio signals SL(i) and SR(i) apply to one of Expression 26 and Expression 27, one of the audio signals SL(i) and SR(i), which is not 0 or which has energy sufficiently larger than the other is determined as the sound source localization signal Y(i).

[Math. 26]

$$(SL(i)=0) \text{ and } (SR(i)\neq 0) \text{ or } (SL(i)\neq 0) \text{ and } (SR(i)=0) \quad \text{(Expression 26)}$$

[Math. 27]

$$\begin{cases} \sum_{i=0}^{N-1} |SL(i)|^2 > TH2 \times \left(\sum_{i=0}^{N-1} |SR(i)|^2\right) \\ \sum_{i=0}^{N-1} |SR(i)|^2 > TH2 \times \left(\sum_{i=0}^{N-1} |SL(i)|^2\right) \end{cases} \quad \text{(Expression 27)}$$

In addition, for the pair of the estimated sound source localization signal and an audio signal of one of the channels, or the pair of estimated sound source localization signals, the estimation of the sound source localization signal, the calculation of the signal component, and the calculation of the sound source position parameter can be carried out in the same manner. More specifically, the sound source localization signal is calculated between the audio signals FL and FR, and the audio signals SL and SR in the above description, and this can be applied to the sound source localization signals X and Y as well. In addition, the sound source localization signal can be calculated between the audio signals FL and SL as well.

More specifically, the sound source localization estimating unit 1 determines whether or not a sound image is localized from the sound source localization signal X(i) and the sound source localization signal Y(i), and the sound source signal separating unit 2 calculates the sound source localization signal Z(i) for each of the frames in which the sound image is localized. To be more specific, it is possible to estimate the sound source localization signal Y(i) and calculate the signal components Y0(*i*) and Y1(*i*) in the same manner as the method that has already been described for the above-described audio signals FL(i) and FR(i), by appropriately substituting each of the variables in each of the expressions in above-described Expression 1 to Expression 14. It is to be noted that the sound source signal separating unit 2 may further separate signal components of a sound source non-localization signal which does not cause a sound image to be localized between the sound source localization signal X(i) and the sound source localization signal Y(i), for example, Xa(i) and Yb(i); however, this process is omitted here in order to simplify the subsequent processes.

In the following description, the audio signal FL(i) is substituted with a sound source localization signal X(i), the audio signal FR(i) is substituted with a sound source localization signal Y(i), the sound source localization signal X(i) is substituted with a sound source localization signal Z(i), the signal component X0(*i*) is substituted with a signal component Z0(*i*), the signal component X1(*i*) is substituted with a signal component Z1(*i*), the angle α is substituted with an angle γ, the angle β is substituted with an angle λ, the angle γ is substituted with an angle θ, in each of the expressions of Expression 1 to Expression 14 With this, Expression 28 to Expression 36 described below are obtained.

[Math. 28]

$$C1 = \frac{\sum_{i=0}^{N-1}\{X(i)\times Y(i)\}}{\sqrt{\sum_{i=0}^{N-1}\{X(i)\times X(i)\}}\times\sqrt{\sum_{i=0}^{N-1}\{Y(i)\times Y(i)\}}} \quad \text{(Expression 28)}$$

First, the sound source localization estimating unit 1 calculates a correlation coefficient C1 which indicates the correlation between the sound source localization signal X(i) and the sound source localization signal Y(i) for each of the frames, using Expression 28. Then the sound source localization estimating unit 1 checks whether or not the calculated correlation coefficient C1 exceeds the threshold TH1 and determines that a sound source localization signal Z(i) is present in a frame in which the correlation coefficient C1 exceeds the threshold TH1. When the sound source localization estimating unit 1 determines that the sound source localization signal Z(i) is present, the sound source signal separating unit 2 calculates a constant a which minimizes a value of 1(L), using Expression 30. Next, the calculated a is substituted into Expression 29 and a signal component Z0(*i*) included in the sound source localization signal X(i) of the sound source localization signal Z(i) is calculated.

[Math. 29]

$$Z0(i) = a\times\left(\frac{X(i)+Y(i)}{2}\right) \quad \text{(Expression 29)}$$

[Math. 30]

$$\Delta(L) = \sum_{i=0}^{N-1}\left(X(i) - a\times\left(\frac{X(i)+Y(i)}{2}\right)\right)^2 \quad \text{(Expression 30)}$$

Likewise, the sound source signal separating unit 2 calculates a constant b which minimizes a value of Δ(R), using Expression 32. Next, the calculated b is substituted into Expression 31 and a signal component Z1(*i*) included in the sound source localization signal Y(i) of the sound source localization signal Z(i) is calculated.

[Math. 31]

$$Z1(i) = b\times\left(\frac{X(i)+Y(i)}{2}\right) \quad \text{(Expression 31)}$$

[Math. 32]

$$\Delta(R) = \sum_{i=0}^{N-1}\left(Y(i) - b\times\left(\frac{X(i)+Y(i)}{2}\right)\right)^2 \quad \text{(Expression 32)}$$

Figure 8:
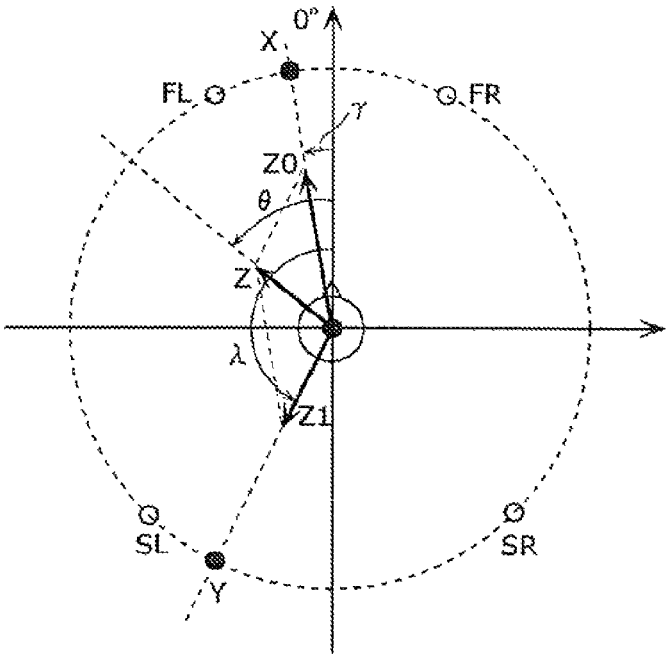
FIG. 8 is an explanation drawing which shows a relationship between the sound source localization signal Z(i), a signal component Z0(*i*), and a signal component Z1(*i*) which are estimated from the sound source localization signals X(i) and Y(i).

FIG. 8 is an explanation drawing which shows a relationship between the sound source localization signal Z(i) and the signal components Z0(*i*) and Z1(*i*) in the acoustic space when the sound source localization signal Z(i) is estimated from the above-described sound source localization signals X(i) and Y(i) and the signal components Z0(*i*) and Z1(*i*) are calculated by the sound source signal separating unit 2, as shown in FIG. 6 and FIG. 7.

In FIG. 8, X and Y denote the direction of arrival of the sound source localization signal X(i) and the direction of arrival of the sound source localization signal Y(i), respectively, and have angles same as the angles γ and λ shown in FIG. 6 and FIG. 7. Z0 and Z1 are signal components in the sound source localization signals X(i) and Y(i) and represent vectors that have magnitudes of energy, respectively, and indicate directions of arrival of a signal. In addition, a vector Z that indicates the direction of arrival of the sound source localization signal Z(i) is obtained by combining the vectors of the signal components Z0 and Z1. An angle that indicates the direction of arrival of the vector Z is indicated by θ. With this, the sound source position parameters of the sound source localization signal Z(i) that is localized in the acoustic space by the audio signals X(i) and Y(i) is calculated.

The sound source position parameter calculating unit 3 calculates, as a parameter that indicates the position of the sound source localization signal Z, the angle θ that indicates the direction of arrival of the sound source localization signal Z with respect to the listening position, based on the energy Z0 and the energy Z1 of the signal components of the sound source localization signal Z and the angles γ and λ that indicate the directions of arrival. The angle θ is calculated using Expression 33. It is to be noted that γ=−λ is not satisfied here, and thus Expression 13 is not used.

[Math. 33]

$$\theta = \arctan\left(\frac{|Z0|\times\sin\gamma + |Z1|\times\sin\lambda}{|Z0|\times\cos\gamma + |Z1|\times\cos\lambda}\right) \quad \text{(Expression 33)}$$

The sound source localization signal Z(i) is a composition of the signal component Z0(*i*) and the signal component Z1(*i*) which are in-phase and included in the sound source localization signal X and the sound source localization signal Y and a relationship based on the energy conservation law is satisfied as shown in Expression 34. This makes it possible to calculate energy L of the sound source localization signal Z(i), using Expression 34.

[Math. 34]

$$L = \sum_{i=0}^{N-1}|Z(i)|^2 = \left(\sum_{i=0}^{N-1}|Z0(i)|^2 + \sum_{i=0}^{N-1}|Z1(i)|^2\right) \quad \text{(Expression 34)}$$

Furthermore, the distance R from the listening position to the sound source localization signal Z can be calculated by substituting the calculated energy L into Expression 15 and the above-described initial to values into L0 and R0.

In addition, even when the correlation coefficient C1 does not exceed the threshold TH1 in the determination performed by the sound source localization estimating unit 1, Expression 35 and Expression 36 are further used to determine whether or not one of the sound source localization signal X(i) and the sound source localization signal Y (i) is 0, or the energy of one of the signals is sufficiently larger than the other. When the sound source localization signals X(i) and Y(i) apply to one of Expression 35 and Expression 36, one of the sound source localization signal X(i) and the sound source localization signal Y(i), which is not 0 or which has energy sufficiently larger than the other is determined as the sound source localization signal Z(i).

[Math. 35]

$$(X(i)=0) \text{ and } (Y(i)\neq 0)$$

or $$(X(i)\neq 0) \text{ and } (Y(i)=0) \quad \text{(Expression 35)}$$

[Math. 36]

$$\begin{cases} \sum_{i=0}^{N-1} |X(i)|^2 > TH2 \times \left( \sum_{i=0}^{N-1} |Y(i)|^2 \right) \\ \sum_{i=0}^{N-1} |Y(i)|^2 > TH2 \times \left( \sum_{i=0}^{N-1} |X(i)|^2 \right) \end{cases} \quad \text{(Expression 36)}$$

It is to be noted that, it has been described that a signal component which does not contribute to localization of the sound image, among signal components included in the sound source localization signal X(i) and the sound source localization signal Y(i), is not calculated; however, the present invention is not limited to this. For example, signal components Xa(i) and Yb(i) which do not contribute to localization of the sound image, among signal components included in ire the sound source localization signal X(i) and the sound source localization signal Y(i), may be calculated to distribute the signal component Xa(i) to FL and FR and the signal component Yb(i) to SL and SL.

As described above, the sound source localization estimating unit 1 estimates the first sound source localization signal X from the audio signals FL and FR of two channels which make a pair among the input audio signals, estimates the second sound source localization signal Y from the audio signals SL and SR of two channels which make another pair, estimates the third sound source localization signal Z from the first sound source localization signal X and the second sound source localization signal Y, and estimates that the third sound source localization signal Z is the sound source localization signal of the input audio signals. It is to be noted that, in contrast, the audio signals of two channels which make a pair are not limited to the pair of FL and FR and the pair of SL and SR but may be any pairs. For example, the combinations may be a pair of FL and SL and a pair of FR and SR.

In addition, it has been described that the sound source localization estimating unit 1 calculates the correlation coefficient between the audio signals FL(i) and FR(i) of two channels which make a pair among the input signals, for each frame which is used as a unit and is provided at a predetermined time interval, and estimates the sound source localization signal from the audio signals of two channels when the correlation coefficient becomes larger than a predetermined value.

In addition, it has been described in the present embodiment that, the sound source localization estimating unit 1 calculates, using, as a unit, a frame which is provided at a predetermined time interval, the correlation coefficient between first sound source localization signal X(i) and the second sound source localization signal Y(i) for each of the frames, and estimates the third sound source localization signal Z(i) from the first sound source localization signal X(i) and the second sound source localization signal Y(i) when the correlation coefficient becomes larger than a predetermined threshold.

Furthermore, the sound source signal separating unit 2 minimizes the square sum of the error between the sum signal of the first sound source localization signal X and the second sound source localization signal Y and the first sound source localization signal X when determining the third sound source non-localization signal Z, thereby separating the third sound source non-localization signal Z.

Furthermore, the sound source signal separating unit 2 minimizes the square sum of the error between the sum signal of the first sound source localization signal X and the second sound source localization signal Y and the second sound source localization signal Y when determining the third sound source non-localization signal Z, thereby separating the third sound source non-localization signal Z.

In addition, the sound source signal separating unit 2 may use, as a unit, a frame which is provided at a predetermined time interval for determining the third sound source non-localization signal Z.

In addition, the sound source position parameter calculating unit 3 may calculate, as a parameter that indicates the position of the sound source localization signal X, the angle $\gamma$ that indicates the direction of arrival of the sound source localization signal with respect to the listening position, based on the energy X0 and the energy X1 of the signal components of the sound source localization signal and the angles $\alpha$ and $\beta$ that indicate the directions of arrival. In addition, the sound source position parameter calculating unit 3 may calculate the distance from the listening position to the sound source localization signal based on the energy of the signal components X0 and X1 of the sound source localization signal. It is possible to calculate the sound source localization signal Y in the same manner, and to calculate the sound source localization signal Z from the sound source localization signals X and Y.

The following describes an operation of the reproduction signal generating unit 4.

First, the reproduction signal generating unit 4 calculates the sound source localization signals to be assigned to the speakers placed in front with respect to the listening position and to the headphones placed near the ears of the listener such that the energy of the sound source localization signal Z(i) is distributed, based on the sound source position parameter. Then the reproduction signal generating unit 4 calculates the sound source localization signals to be assigned to the right and left channels of the speakers and the headphones such that the energy of the assigned sound source localization signal Z(i) is distributed. Then the sound source non-localization signals for the respective channels which have been separated in the sound source signal separating unit 2 in advance are combined to the assigned sound source localization signals of the respective channels, thereby generating reproduction signals.

First, an operation of calculating sound source signals such that the energy of the sound source localization signal is distributed to the speakers that make a pair placed in front with respect to the listening position and to the headphones which make a pair placed near the ears of the listener.

Figure 9:
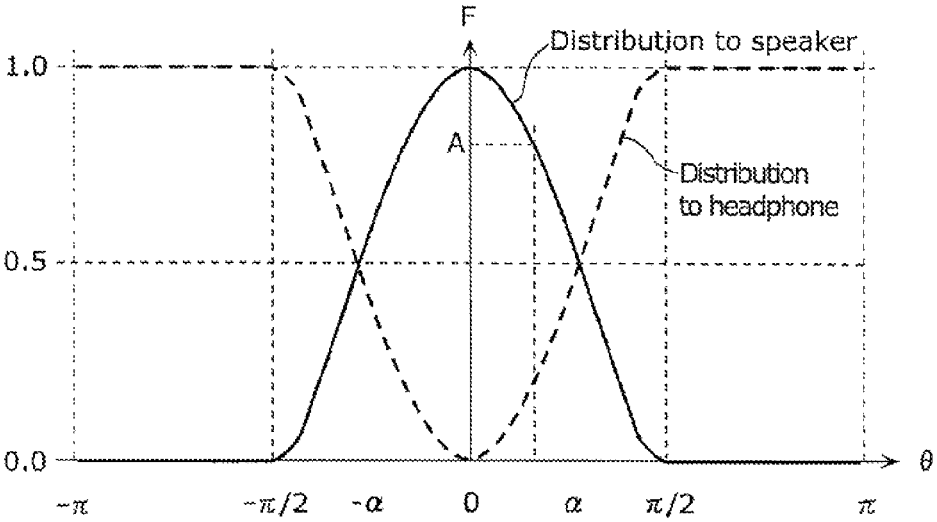
FIG. 9 is an explanation drawing which shows a function for distributing the sound source localization signal Z(i), based on an angle θ that indicates a direction of arrival of the sound source localization signal, to speakers placed in front with respect to a listening position and to headphones placed near the ears of a listener.

FIG. 9 is an explanation drawing which shows a distribution amount F($\theta$) for distributing the energy of the sound source localization signal Z(i), based on the angle $\theta$ that indicates the direction of arrival among the sound source position parameters, to the speakers placed in front with respect to the listening position. In FIG. 9, the horizontal axis indicates the angle $\theta$ that indicates the direction of arrival of the sound source localization signal among the sound source position parameters, and the vertical axis shows the distribution amount of the signal energy. It is to be noted that the solid line in the diagram indicates the distribution amount F($\theta$) to the speakers placed in front with respect to the listening position and the broken line indicates the distribution amount (1.0−F(θ)) to the headphones placed near the ears of a listener.

Here, the function F(θ) shown in FIG. 9 can be represented by Expression 37, for example. More specifically, the example shown in FIG. 9 indicates that all the energy is distributed to the speakers placed in front with respect to the listening position when the angle θ indicating the direction of arrival of the sound source localization signal Z(i) is an angle from a reference that is the front of the listening position, and the distribution amount decreases as the angle θ approaches 90 degrees (π/2 radian). Likewise, it is indicated that the distribution amount decreases as the angle θ approaches −90 degrees (−π/2 radian). It is to be noted that, when the angle θ becomes larger than 90 degrees (π/2 radian) or smaller than −90 degrees (−π/2 radian), it is indicated that the sound source localization signal Z(i) is localized behind the listening position, and thus the energy is not distributed to the speakers placed in front with respect to the listening position.

[Math. 37]

$$F(\theta) = \begin{cases} \cos(\theta) & -z/2 < \theta < z/2) \\ 0.0 & (-z \le \theta \le -z/2,\ x/2 \le \theta \le z) \end{cases} \quad \text{(Expression 37)}$$

Here, since F(θ) shown in Expression 37 is the distribution amount of the energy of the sound source localization signal Z(i), it is possible to calculate the sound source localization signal Zf(i) assigned to the speakers placed in front with respect to the listening position, by multiplying the square root of F(θ), as a coefficient, by the sound source localization signal Z(i) as shown in Expression 38.

[Math. 38]

$$Z_f(i=\sqrt{F(\theta)}\times Z(i) \quad \text{(Expression 38)}$$

In addition, the sound source localization signal Zh(i) assigned to the headphones placed close to the ears of the listener can be calculated by multiplying the square root of (1.0−F(θ)) by the sound source localization signal Z(i) as shown in Expression 39.

[Math. 39]

$$Z_f(i)=\sqrt{1.0-F(\theta)}\times Z(i) \quad \text{(Expression 39)}$$

However, the sound image that is localized can be more clearly perceived in some cases by assigning the energy to the headphones placed close to the ears of the listener, irrespective of the angle α that indicates the direction of arrival, depending on the energy of the sound source localization signal Z(i). More specifically, it is when the energy of the sound source localization signal Z(i) is large. Since a sound image is localized near the listening position when the energy of the sound source localization signal Z(i) is large, the listener can more clearly perceive the sound image that is localized by assigning the sound source localization signals to the headphones placed near the ears of the listener than assigning the energy to the speakers placed in front with respect to the listening position.

The following describes a process of assigning the sound source localization signals in consideration of a distance R from the listening position to the sound source localization signal Z(i).

Figure 10:
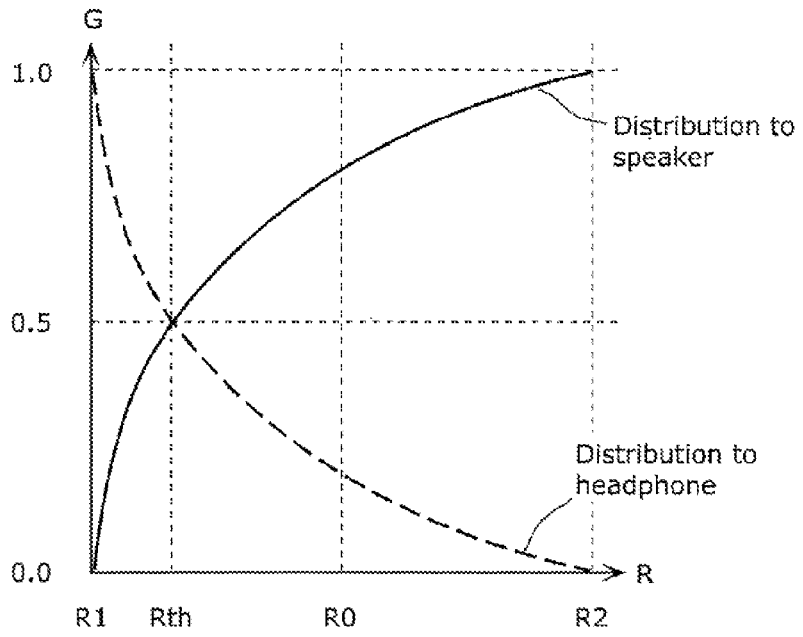
FIG. 10 is an explanation drawing which shows a function for distributing the sound source localization signal Z(i), based on a distance R from the listening position to a localization position of the sound source localization signal, to the speakers placed in front with respect to the listening position and to the headphones placed near the ears of the listener.

FIG. 10 is an explanation drawing which shows a distribution amount G(R) for distributing the energy of the sound source localization signal Z(i), based on a distance R from the listening position to the sound source localization signal Z(i) among the sound source position parameters which show the position of the acoustic space, to the speakers placed in front with respect to the listening position and to the headphones placed near the ears of the listener.

In FIG. 10, the horizontal axis indicates the distance R, among the sound source position parameters, from the listening position to the sound source localization signal and the vertical axis shows the distribution amount of the signal energy. It is to be noted that the solid line in the diagram indicates the distribution amount G(R) to the speakers placed in front with respect to the listening position and the broken line indicates the distribution amount (1.0−G(R)) to the headphones placed near the ears. More specifically, the example shown in FIG. 10 indicates that all the energy is distributed to the speakers placed in front with respect to the listening position when the distance R from the listening position of the sound source localization signal Z(i) becomes equal to or larger than a distance R2, and the distribution amount decreases as the distance from the listening position decreases.

It is to be noted that, in order to distribute the energy based on the distance R from the listening position, it is possible to calculate the sound source localization signal Zf(i) assigned to the speakers placed in front with respect to the listening position, by multiplying a square root of the multiplication of F(θ) based on the angle θ that indicates the above-described direction of arrival and the distance R from the listening position by the sound source localization signal Z(i) as shown in Expression 40, for example.

[Math. 40]

$$Z_f(i)=\sqrt{G(R)\times F(\theta)}\times Z(i) \quad \text{(Expression 40)}$$

It is to be noted that the sound source localization signal Zh(i) to be assigned to the headphones placed close to the ears of the listener is calculated, in order to conserve energy, by Expression 41.

[Math. 41]

$$Z_h(i)\sqrt{1.0-G(R)\times F(\theta)}\times Z(i) \quad \text{(Expression 41)}$$

The following describes a process of assigning, to the right and left channels of the speakers placed in front with respect to the listening position and the headphones placed near the ears, the sound source localization signals Zf(i) and Zh(i) assigned to the speakers which make a pair and are placed in front with respect to the listening position and to the headphones which make a pair are placed near the ears of the listener.

As described above, the reproduction signal generating unit 4 may distribute the energy of the sound source localization signal Z to the speaker 5, the speaker 6, the headphone 7, and the headphone 8, according to F(θ) and G(R) based on the angle θ which shows the direction of arrival of the sound source localization signal Z and the distance R from the listening position to the sound source localization signal.

Figure 11:
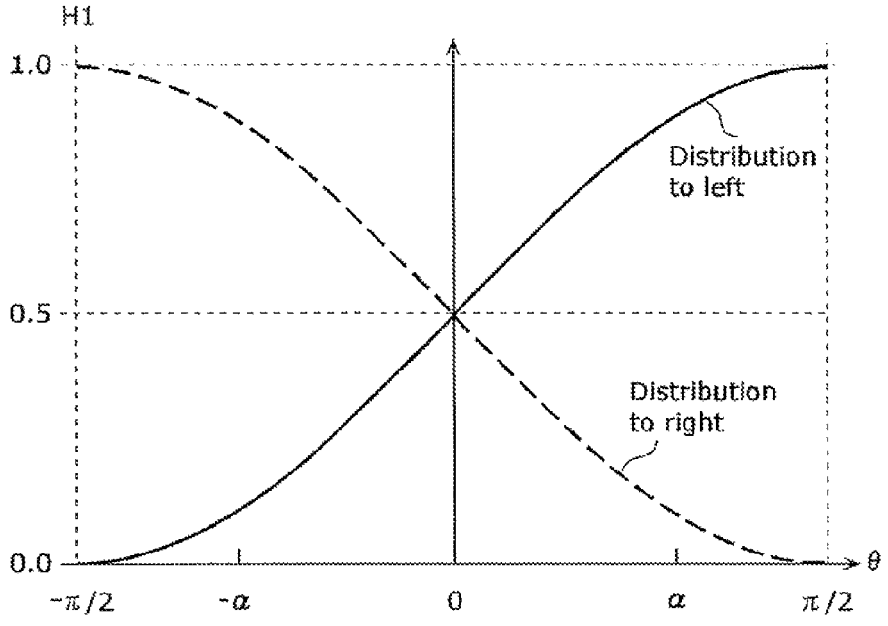
FIG. 11 is an explanation drawing which shows a function for distributing the sound source localization signal Zf(i), based on the angle θ that indicates a direction of arrival of the sound source localization signal, to speakers placed right and left in front with respect to the listening position.

First, the following describes a process of assigning, to the right and left channels, the sound source localization signal Zf(i) to be assigned to the speakers which make a pair and are placed in front with respect to the listening position. FIG. 11 is an explanation drawing which shows a distribution amount H1(θ) for distributing, to the right and left channels, the energy of the sound source localization signal Zf(i) assigned to the speakers placed in front with respect to the listening position, based on the angle θ that indicates a direction of arrival among the sound source position parameters. In FIG. 11, the in horizontal axis indicates the angle θ that indicates the direction of arrival, among the sound source position parameters, and the vertical axis shows the distribution amount to the right and left channels. It is to be noted that the solid line in the diagram shows the distribution amount H1(θ) to the left channel and the broken line shows the distribution amount (1.0−H1(θ)) to the right channel. Here, the function H1(θ) shown in FIG. 11 can be represented by Expression 42, for example. More specifically, the example shown in FIG. 11 indicates that the energy are distributed fifty-fifty to the right and left channels when the angle θ that indicates the direction of arrival of the sound source localization signal Z(i) is an angle of which a reference direction is the front of the listening position and the distribution amount increases as the angle θ approaches 90 degrees (π/2 radian). Conversely, it is indicated that the distribution amount decreases as the angle θ approaches −90 degrees (−π/2 radian).

[Math. 42]

$$H1(\theta) = 0.5 \times \left(1.0 - \cos\left(\theta - \frac{\pi}{2}\right)\right) \ (-z/2 \le \theta \le \pi/2) \qquad \text{(Expression 42)}$$

Here, since H1(θ) shown in Expression 42 is the distribution amount of the energy of the sound source localization signal Zf(i), it is possible to calculate the sound source localization signal ZfL(i) assigned to the speaker of the left channel, by multiplying the square root of H1(θ), as a coefficient, by the sound source localization signal Zf(i) as shown in Expression 43.

[Math. 43]

$$Z_{fL}(i) = \sqrt{H1(\theta)} \times Z_f(i) \qquad \text{(Expression 43)}$$

Furthermore, the sound source localization signal ZfR(i) assigned to the speaker of the right channel can be calculated by multiplying the square root of (1.0−H1(θ)) by the sound source localization signal Zf(i) as shown in Expression 44.

[Math. 44]

$$Z_{hR}(i) = \sqrt{1.0 - H1(\theta)} \times Z_f(i) \qquad \text{(Expression 44)}$$

Figure 12:
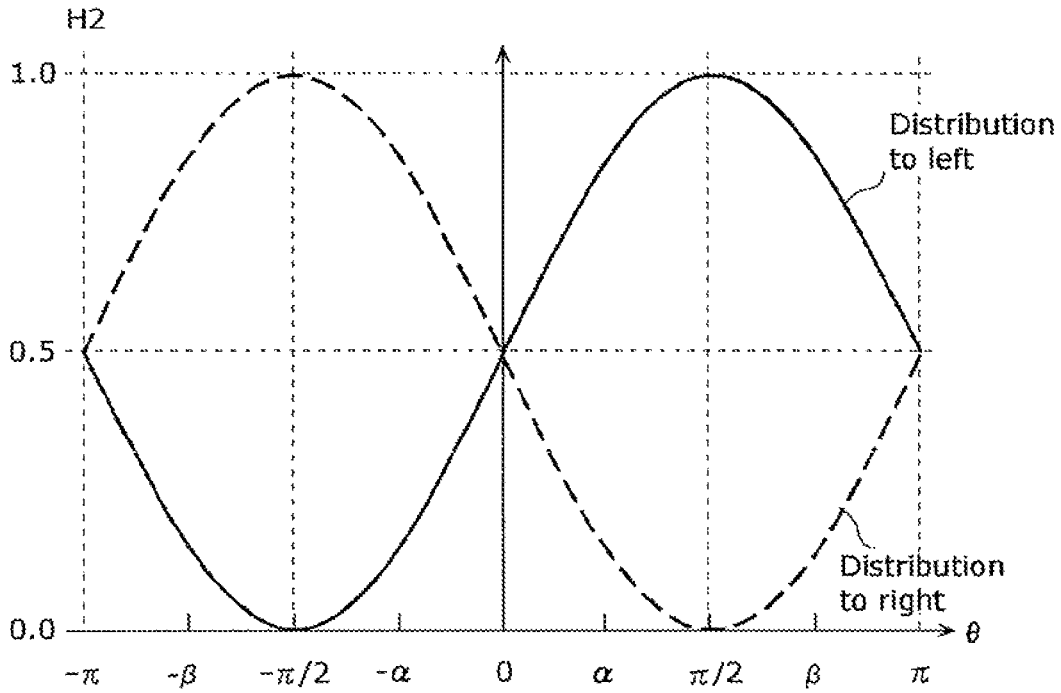
FIG. 12 is an explanation drawing which shows a function for distributing the sound source localization signal Zh(i), based on the angle θ that indicates the direction of arrival of the sound source localization signal, to the headphones placed right and left near the ears of the listener.

Next, a process of assigning, to the right and left channels, the sound source localization signal Zh(i) assigned to the headphones which make a pair and are placed close to the ears of the listener is explained. FIG. 12 is an explanation drawing which shows an example of a function H2(θ) that derives a coefficient for distributing, to the right and left channels, the energy of the sound source localization signal Zh(i) assigned to the headphones placed near the ears of the listener, based on the angle θ that indicates the direction of arrival among the sound source position parameters. In FIG. 12, the horizontal axis indicates the angle θ that indicates the direction of arrival, among the sound source position parameters, and the vertical axis shows the distribution amount to the right and left channels. It is to be noted that the solid line in the diagram shows the distribution amount H2(θ) to the left channel and the broken line shows the distribution amount (1.0−H2(θ)) to the right channel. Here, the function H2(9) shown in FIG. 12 can be represented by Expression 45, for example. More specifically, the example shown in FIG. 12 indicates that the energy is distributed fifty-fifty to the right and left channels when the angle θ that indicates the direction of arrival of the sound source localization signal Z(i) is a reference of the front with respect to the listening position and the distribution amount increases as the angle θ approaches 90 degrees (π/2 radian), and all the energy is distributed to the left channels when the angle θ becomes 90 degrees (π/2 radian). In addition, it is indicated that the distribution amount decreases as the angle θ approaches 180 degrees (π radian) from 90 degrees (π/2 radian), and the energy is distributed fifty-fifty to the right and left channels when the angle θ becomes 180 degrees (π radian). Conversely, it is indicated that the to distribution amount decreases as the angle θ approaches −90 degrees (−π/2 radian) from the reference of the front of the listening position, and no energy is distributed to the left channel when the angle θ becomes −90 degrees (−π/2 radian). Furthermore, it is indicated that the distribution amount increases as the angle θ approaches −180 degrees (−π radian) of the front behind the listening position from −90 degrees (−π/2 radian).

[Math. 45]

$$H2(\theta) = 0.5 \times \left(1.0 + \cos\left(\theta - \frac{\pi}{2}\right)\right) \ (-\pi \le \theta \le \pi) \qquad \text{(Expression 45)}$$

Here, since H2(θ) shown in Expression 45 is the distribution amount of the energy of the sound source localization signal Zh(i), it is possible to calculate the sound signal ZhL(i) assigned to the headphone of the left channel, by multiplying the square root of H2(θ), as a coefficient, by the sound source localization signal Zh(i) as shown in Expression 46

[Math. 46]

$$Z_{hL}(i) = \sqrt{H2(\theta)} \times Z_h(i) \qquad \text{(Expression 46)}$$

Furthermore, the sound source localization signal ZhR(i) assigned to the headphone of the right channel can be calculated by multiplying the square root of (1.0−H2(θ)) by the sound source localization signal Zh(i) as shown in Expression 47.

[Math. 47]

$$Z_{hR}(i) = \sqrt{1.0 - H2(\theta)} \times Z_d(i) \qquad \text{(Expression 47)}$$

Lastly, a reproduction signal is generated by combining sound source 1.0 localization signals distributed to the speakers and headphones of the respective channels and the sound source non-localization signals of the respective channels, which have been separated in advance by the sound source signal separating unit 2 and which do not cause a sound image to be localized in the acoustic space, in the manner as described above. More specifically, the reproduction signal of each of the channels can be represented by Expression 48 based on the angle θ that indicates the direction of arrival of the sound source localization signal Z(i) and the sound source signal, the distance R from the listening position, and the sound source non-localization signal of each of the channels. The sound source localization signals to be distributed to the respective channels of the speakers and the headphones are the sound source localization signals calculated using the above-described Expression 43, Expression 44, Expression 46, and Expression 47. In addition, the sound source non-localization signals which do not cause a sound image to be localized in the acoustic space of the respective channels are represented as FLa(i), FRb(i), SLa(i), and SRb(i) and are calculated in the same manner as in Expression 8 of the description for the operation of the above-described sound source signal separating unit 2. It is to be noted that the sound source localization signals ZhL(i) and ZhR(i) assigned to the headphone when the angle θ that indicates the direction of arrival among the sound source position parameters of the sound source localization signal is (−π≤θ≤−π/2) or (π/2≤θ≤π) are the sound source localization signals which are localized at the distance R from the listening position to the sound source localization signal among the sound source position parameters and combined to be output from the right and left channels of the headphones placed close to the ears of the listener, after a predetermined coefficient K0 for adjusting an energy level perceived by the listener is multiplied. In addition, SLa(i) and SRa(i) are sound source non-localization signals included in the audio signals SL(i) and SR(i) assigned to right in and left behind the listening position and are combined to be output from the right and left channels of the headphones placed close to the ears of the listener, after a predetermined coefficient K for adjusting an energy level perceived by the listener is multiplied.

[Math. 48]

$$\begin{cases} SPL(i) = Z_{fL}(i) + FL_a(i) = \sqrt{H1(\theta)} \times \left(\sqrt{G(R) \times F(\theta)} \times Z(i)\right) + FL_a(i) \\ SPR(i) = Z_{fR}(i) + FR_b(i) = \sqrt{1.0 - H1(\theta)} \times \left(\sqrt{G(R) \times F(\theta)} \times Z(i)\right) \times FR_b(i) \\ HPL(i) = K_0 \times Z_{hL}(i) + K_1 \times SL_a(i) = K_0 \times \sqrt{H2(\theta)} \times \sqrt{1.0 - G(R) \times F(\theta)} \times Z(i) + K_1 \times SL_a(i) \\ HPR(i) = K_0 \times Z_{hR}(i) + K_1 \times SR_b(i) = K_0 \times \sqrt{1.0 - H2(\theta)} \times \sqrt{1.0 - G(R) \times F(\theta)} \times Z(i) + K_1 \times SR_b(i) \end{cases} \quad \text{(Expression 48)}$$

The predetermined coefficient K0 in Expression 48 described above is a coefficient for adjusting, when the angle θ is (−π≤θ≤−π/2) or (π/2≤θ≤π), the sound source localization signal which is localized at the distance R from the listening position of the sound source localization signal such that the level difference in the sound pressure when listening at the listening position becomes even, based on the sound source position parameter of the sound source localization signal, and may be calculated by Expression 49, for example. In addition, the predetermined coefficient K1 is a coefficient for adjusting the same audio signals output from the speakers placed in front with respect to the listening position and from the headphones placed near the ears of the listener such that the level difference in the sound pressure when listening at the listening position becomes even, and may be calculated, for example, by Expression 50 using the distance R2 from the listening position to the headphone and the distance R1 from the listening position to the speakers placed in front with respect to the listening position.

[Math. 49]

$$K_0 = \begin{cases} 1.0 & (-\pi/2 < \theta < \pi/2) \\ R1/R & (-\pi \le \theta \le -\pi/2, \pi/2 \le \theta \le \pi) \end{cases} \quad \text{(Expression 49)}$$

[Math. 50]

$$K_1 = R1/R2 \quad \text{(Expression 50)}$$

In addition, the above-described coefficients K0 and K1 may be adjusted by a listener through operating a switch on the sound reproduction apparatus 10 based on auditory capability of the listener.

It is to be noted that, in the description for the operation of the reproduction signal generating unit 4 described above, sound source localization signals to be assigned to the speakers and the headphones are first calculated based on the sound source position parameters, and then sound source localization signals to be assigned to the right and left channels of the speakers and the headphones are calculated; however, the sound source localization signals to be assigned to the right and left channels may be calculated first, and then the sound source localization signals to be assigned to the speakers and the headphones may be calculated.

In addition, a difference occurs in some cases in the energy level perceived by a listener due to an efficiency variance of sound reproduction between the speakers placed in front with respect to the listening position and the headphones placed near the ears of the listener. In view of the above, in order to generate an optimal reproduction signal for various combinations of reproduction characteristics of the sound reproduction, for example, the reproduction audio signal that is output to the headphones may be multiplied by a predetermined coefficient K2 as shown in Expression 50, for each of the reproduction signals calculated by Expression 48, thereby adjusting an attenuation amount such that the difference in the energy level perceived by a listener is compensated.

[Math. 51]

$$\begin{cases} SPL(i) = Z_{fL}(i) + FL_a(i) = \sqrt{H1(\theta)} \times \left(\sqrt{G(R) \times F(\theta)} \times Z(i)\right) + FL_a(i) \\ SPR(i) = Z_{fR}(i) + FR_b(i) = \sqrt{1.0 - H1(\theta)} \times \left(\sqrt{G(R) \times F(\theta)} \times Z(i)\right) \times FR_b(i) \\ HPL(i) = K_2 \times (K_0 \times Z_{hL}(i) + K_1 \times SL_a(i)) = K_2 \times \left( \begin{array}{c} K_0 \times \sqrt{H2(\theta)} \times \\ \sqrt{1.0 - G(R) \times F(\theta)} \times \\ Z(i) + K_1 \times SL_a(i) \end{array} \right) \\ HPR(i) = K_2 \times (K_0 \times Z_{hR}(i) + K_1 \times SR_b(i)) = K_2 \times \left( \begin{array}{c} K_0 \times \sqrt{1.0 - H2(\theta)} \times \\ \sqrt{1.0 - G(R) \times F(\theta)} \times \\ Z(i) + K_1 \times SR_b(i) \end{array} \right) \end{cases} \quad \text{(Expression 51)}$$

Here, the predetermined coefficient K2 is calculated using, for example, an output sound pressure level that is a general index that indicates an efficiency of the sound reproduction, and using, for example, Expression 51 when the output sound pressure level of the speakers placed in front with respect to the listening position is P0 [dB/W] and the output sound pressure level of the headphones is P1 [dB/W].

[Math. 52]

$$K_2 = 10^{((P0-P1);20)} \quad \text{(Expression 52)}$$

Figure 13:
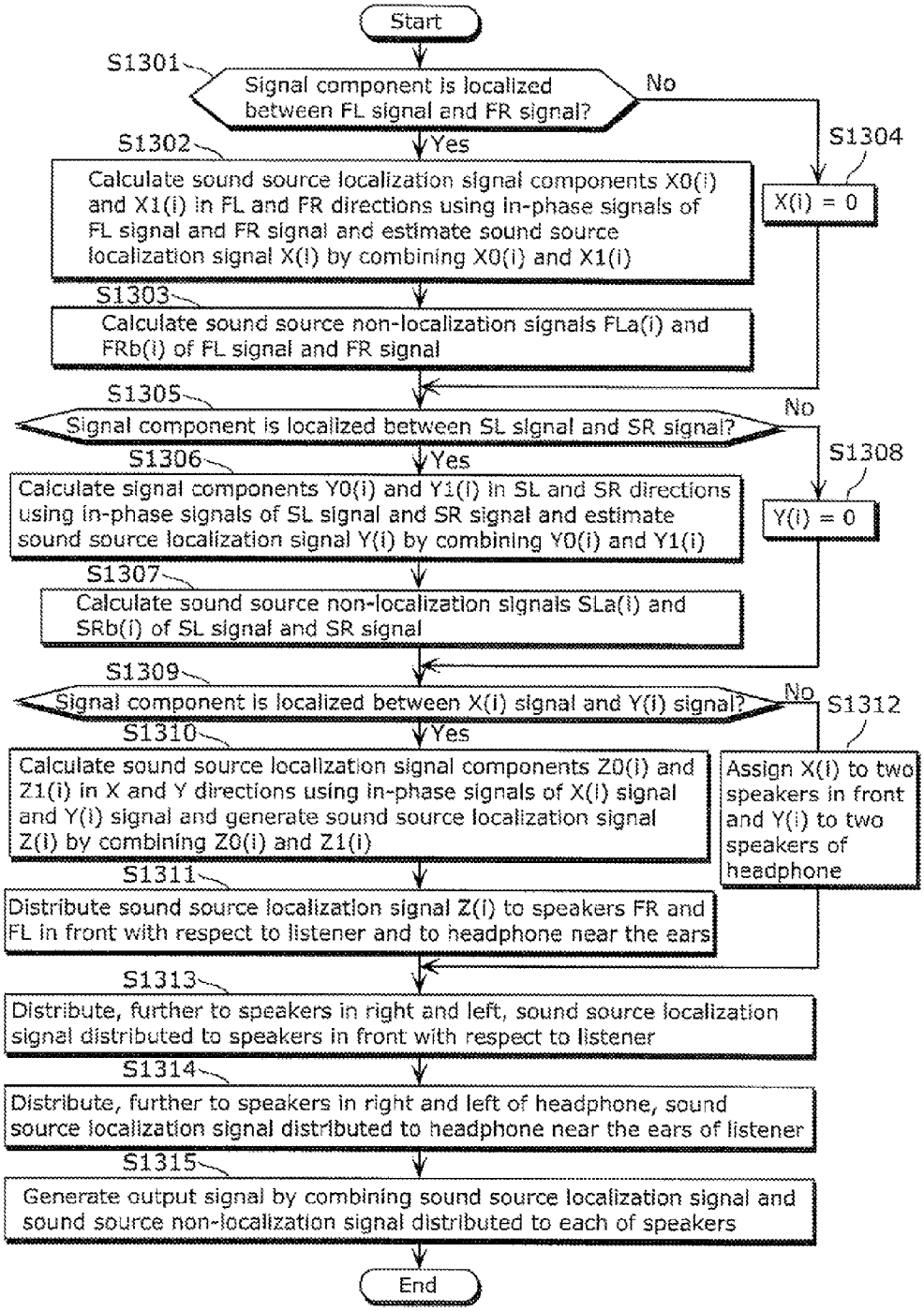
FIG. 13 is a flow chart which shows an operation of the sound reproduction apparatus according to the embodiment of the present invention.

In addition, the above-described coefficients K2 may also be adjusted by a listener through operating a switch on the sound reproduction apparatus 10 based on auditory capability of the listener FIG. 13 is a flow chart which shows an operation of the sound reproduction apparatus according to the embodiment of the present invention. In the sound reproduction apparatus 10, the sound source localization estimating unit 1 determines whether or not a sound source localization signal X(i) is localized between an audio signal FL(i) and an audio signal FR(i) which are assigned to the speakers placed in front with respect to the listening position (S1301).

When the sound source localization estimating unit 1 determines that the sound source localization signal X(i) is localized (Yes in S1301), the sound source signal separating unit 2 calculates a signal component X0 (*i*) in the FL direction and a signal component X1 (*i*) in in the FR direction of the sound source localization signal X(i), using an in-phase signal of the audio signals FL(i) and FR(i) (S1302).

Next, the sound source signal separating unit 2 calculates sound source non-localization signals FLa(i) and FRb(i) included in the audio signals FL(i) and FR(i) and separates the sound source non-localization signals FLa(i) and FRb(i) from the audio signals FL(i) and FR(i). In addition, the sound source signal separating unit 2 calculates a parameter that indicates a localization position of a sound source localization signal X(i) obtained by combining the calculated signal component X0(*i*) and the signal component X1(*i*) (S1303). The parameter includes a distance R from the listening position to the localization position of the sound source localization signal X(i) and an angle γ from the front of the listening position to the localization position.

When the sound source localization estimating unit 1 determines that the sound source localization signal X(i) is not localized (No in S1.301), the sound source signal separating unit 2 determines that the sound source localization signal X(i)=0, FLa(i)=FL(i), and FRb(i)=FR(i) (S1304).

Furthermore, the sound source localization estimating unit 1 determines whether or not a sound source localization signal Y(i) is localized between an audio signal SL(i) and an audio signal SR(i) which are assigned to the speakers that are assumed to be placed in predetermined positions behind a listener (S1305).

When the sound source localization estimating unit 1 determines that the sound source localization signal Y(i) is localized (Yes in S1305), the sound source signal separating unit 2 calculates a signal component Y0(*i*) in the SL direction and a signal component Y1(*i*) in the SR direction of the sound source localization signal Y(i), using an in-phase signal of the audio signals SL(i) and SR(i) (S1306).

Next, the sound source signal separating unit 2 calculates a sound source non-localization signals SLa(i) and SRb(i) included in the audio signals SL(i) and SR(i) and separates the sound source non-localization signals SLa(i) and SRb(i) from the audio signals SL(i) and SR(i). In addition, the sound source signal separating unit 2 calculates a parameter that indicates a localization position of a sound source localization signal Y(i) obtained by combining the calculated signal component Y0(*i*) and the signal component Y1(*i*) (S1307). The parameter includes a distance R from the listening position to the localization position of the sound source localization signal Y(i) and an angle λ from the front of the listening position to the localization position.

When the sound source localization estimating unit 1 determines that the sound source localization signal Y(i) is not localized (No in S1305), the sound source signal separating unit 2 determines that the sound source localization signal Y(i)=0, SLa(i)=SL(i), and SRb(i)=SR(i) (S1308).

Furthermore, the sound source localization estimating unit 1 determines whether or not a sound source localization signal Z(i) is localized between the sound source localization signal X(i) calculated in Step S1302 and the sound source localization signal Y(i) calculated in Step S1306 (S1309).

When the sound source localization estimating unit 1 determines that the sound source localization signal Z(i) is localized (Yes in S1309), the sound source signal separating unit 2 calculates a signal component Z0(*i*) in the X direction and a signal component Z1(*i*) in the Y direction of the sound source localization signal Z(i), using an in-phase signal of the sound source localization signal X(i) and the sound source localization signal Y(i). In addition, the sound source signal separating unit 2 calculates a parameter that indicates a localization position of a sound source localization signal Z(i) obtained by combining the calculated signal component Z0(*i*) and the signal component Z1(*i*) (S1310). The parameter includes a distance R from the listening position to the localization position of the sound source localization signal Z(i) and an angle θ from the front of the listening position to the localization position.

Next, the reproduction signal generating unit 4 distributes the calculated sound source localization signal Z(i) to the speaker 5 and the speaker 6 which are placed in front of the listener and to the headphone 7 and the headphone 8 which are placed near the ears of the listener (S1311). The sound source localization signal Zf(i) assigned to the speakers placed in front of the listener are calculated according to Expression 40. The sound source localization signal Zh(i) assigned to the headphones placed near the ears of the listener is calculated according to Expression 41.

When the sound source localization estimating unit 1 determines that the sound source localization signal Z(i) is not localized (No in S1309), the reproduction signal generating unit 4 assigns the sound source localization signal X(i) calculated in Step S1302 to the speaker 5 and the speaker 6 which are placed in front of the listener, and assigns the sound source localization signal Y(i) calculated in Step S1306 to the headphone 7 and the headphone 8 which are placed near the ears of the listener (S1312). More specifically, the sound source localization signal Zf(i) assigned to the speakers placed in front of the listener is Zf(i)=X(i), and the sound source localization signal Zh(i) assigned to the headphones placed near the ears of the listener is Zh(i)=Y(i).

Furthermore, the reproduction signal generating unit 4 distributes the sound source localization signal Zf(i) assigned to the two speakers placed in front of the listener in Step S1311 or Step S1312 to the right and left speakers 5 and 6 (S1313). More specifically, the reproduction signal generating unit 4 calculates the sound source in localization signal ZfL(i) assigned to the speaker 5 of the left channel, which is placed in front with respect to the listening position, according to Expression 42 and Expression 43, and calculates the sound source localization signal ZfR(i) assigned to the speaker of the right channel, which is placed in front with respect to the listening position, according to Expression 44.

Next, the reproduction signal generating unit 4 distributes the sound source localization signal Zh(i) assigned to the two headphones placed near the ears of the listener in Step S1311 or Step S1312 to the right and left headphones 7 and 8 (S1314). More specifically, the reproduction signal generating unit 4 calculates the sound source signal ZhL(i) assigned to the headphone 7 of the left channel, which is placed near the ear, according to Expression 45 and Expression 46, and calculates the sound source localization signal ZhR(i) assigned to the headphone 8 of the right channel, which is placed near the ear, according to Expression 47.

Furthermore, the reproduction signal generating unit 4 combines, according to Expression 48 and Expression 49, the sound source localization signals ZfL(i), ZfR(i), ZhL(i), and ZhR(i) which are distributed to the respective speakers in Step S1313 and Step 1314 and the sound source non-localization signals FLa(i), FRb(i), SLa(i), and SRb(i) which are calculated in Step S1303 and Step S1307, and generates a reproduction signal SPL(i) to be output to the speaker 5, a reproduction signal SPR(i) to be output to the speaker 6, a reproduction signal HPL(i) to be output to the headphone 7, and a reproduction signal HPR(i) to be output to the headphone 8 (S1315).

As described above, the sound reproduction apparatus 10 according to the present invention estimates a sound source localization signal for localizing a sound image in an acoustic space in view of not only the horizontal direction but also the front-back direction in the acoustic space, calculates a sound source position parameter which indicates a position in the acoustic space, and assigns the sound source signal to each of the channels so as to distribute energy to each of the channels based on the calculated sound source position parameter. This allows reproduction of a stereophonic audio with improved stereophonic perception such as the spread of a reproduced sound in the front-back direction and the movement of a sound image that is localized in the acoustic space, which can provide more preferable realistic sensation.

In addition, it is possible to improve accuracy of the processes of estimation of a sound source localization signal, separation of the sound source localization signal from a sound source non-localization signal, and calculation of a sound source position parameter, by removing in advance a signal component of a frequency with which a sense of localization is difficult to be perceived from an input audio signal.

It is to be noted that, in the embodiment described above, an example of a method of estimating a sound source localization signal and a method of calculating a distance from a listening position to the sound source localization signal is shown by setting the threshold TH1 to be 0.5, the threshold TH2 to be 0.001, and the reference distance R0 to be 1.0 m; however, these numerical values are merely examples and, in practice, optimal numerical values may be determined by simulation or the like.

In addition, a software program for implementing each of the processing steps of configuration blocks of the sound reproduction apparatus 10 according to the present invention described above may be performed by a computer, a digital signal processor (DSP), and the like With the audio reproduction apparatus according to the present invention as described above, it is possible to provide a reproduction apparatus for a stereophonic audio with improved stereophonic perception, compared to conventional techniques, such as the spread of a reproduced sound in the front-back direction and the movement of a sound image that is localized in the acoustic space.

REFERENCE SIGNS LIST

1 sound source localization estimating unit
2 sound source signal separating unit
3 sound source position parameter calculating unit
4 reproduction signal generating unit
5 speaker
6 speaker
7 headphone
8 headphone
10 sound reproduction apparatus

The invention claimed is:

1. A sound reproduction apparatus which reproduces input audio signals using front speakers and ear speakers, the input audio signals being multi-channel and assumed to be reproduced using corresponding speakers placed in predetermined standard positions in an acoustic space, the front speakers being placed in the standard positions in front with respect to a listening position, and the ear speakers being placed near the listening position and in positions different from any of the standard positions, the sound reproduction apparatus comprising:

a non-transitory memory configured to store a program; and a hardware processor configured to execute the program and cause the sound reproduction apparatus to operate as:

a sound source localization estimating unit configured to estimate, from the input audio signals, whether or not a sound image is localized in the acoustic space when it is assumed that the input audio signals are reproduced using the speakers placed in the standard positions;

a sound source signal separating unit configured to calculate, when the sound source localization estimating unit estimates that the sound image is localized, a sound source localization signal that is a signal indicating the sound image that is localized;

a sound source position parameter calculating unit configured to calculate, from the sound source localization signal, a parameter that indicates a localization position of the sound image indicated by the sound source localization signal; and a reproduction signal generating unit configured to distribute the sound source localization signal to the front speakers and the ear speakers using the parameter that indicates the localization position, and to generate a reproduction signal to be supplied to the front speakers and the ear speakers, wherein the sound source localization estimating unit is configured to estimate whether or not the sound image is localized using the input audio signals of two channels which make a pair among the input audio signals, and the sound source signal separating unit is configured to (i) minimize a square sum of an error between a sum signal of the input audio signals of the two channels which make a pair and one of the input audio signals included in the pair to calculate a signal component of the sound source localization signal included in the one of the input audio signals, and (ii) separate the signal component of the sound source localization signal from the one of the input audio signals.

2. The sound reproduction apparatus according to claim 1, wherein the sound source signal separating unit is further configured to separate, from each of the input audio signals, a sound source non-localization signal that is a signal component which is included in each of the input audio signals and does not contribute to localization of the sound image in the acoustic space, and the reproduction signal generating unit is configured to generate (i) a reproduction signal to be supplied to the front speakers, by combining the sound source localization signal distributed to the front speakers and the sound source non-localization signal separated from each of the input audio signals to be reproduced by the speakers placed in the standard positions in front with respect to the listening position and (ii) a reproduction signal to be supplied to the ear speakers, by combining the sound source localization signal distributed to the ear speakers and the sound source non-localization signal separated from each of the input audio signals to be reproduced by the speakers placed in the standard positions in back with respect to the listening position.

3. The sound reproduction apparatus according to claim 2, wherein the reproduction signal generating unit is configured to generate the reproduction signal by combining the sound source localization signal and the sound source non-localization signal at a predetermined ratio that is adjustable through an operation by a listener, the sound source localization signal being distributed to each of the channels of the front speakers and the ear speakers, and the sound source non-localization signal being separated by the sound source signal separating unit.

4. The sound reproduction apparatus according to claim 1, wherein the reproduction signal generating unit is configured to (i) distribute energy of the sound source localization signal to the front speakers and the ear speakers, using an angle that indicates a direction of arrival of the sound source localization signal from the localization position to the listening position and a distance from the listening position to the localization position of the sound source localization signal and (ii) distribute the energy of the sound source localization signal to each of right and left channels of the front speakers and the ear speakers, using the angle that indicates the direction of arrival of the sound source localization signal.

5. The sound reproduction apparatus according to claim 1, wherein the reproduction signal generating unit is configured to multiply, by a predetermined attenuation coefficient, the reproduction signal to be supplied to the ear speakers, based on (i) a ratio of a distance between one of the front speakers and the listening position to a distance between one of the ear speakers and the listening position and (ii) a ratio of a distance from the localization position of the sound image indicated by the parameter to the listening position to a distance between the one of the ear speakers and the listening position.

6. The sound reproduction apparatus according to claim 1, wherein the sound source localization estimating unit is configured to (i) calculate a correlation coefficient between the input audio signals of two channels which make a pair among the input audio signals, for each frame which is used as a unit and is provided at a predetermined time interval, and (ii) estimate that the sound image indicated by the sound source localization signal is localized using the input audio signals of the two channels, when the correlation coefficient is larger than a predetermined value.

7. The sound reproduction apparatus according to claim 1, wherein the sound source signal separating unit is configured to separate a sound source non-localization signal from each of the input audio signals, using a ratio of energy of each of the input audio signals to energy of the signal component of the sound source localization signal included in each of the input audio signals.

8. The sound reproduction apparatus according to claim 1, wherein the sound source position parameter calculating unit is configured to calculate, as a parameter that indicates the localization position of the sound image indicated by the sound source localization signal, an angle that indicates a direction of arrival of the sound source localization signal with respect to the listening position and a distance from the listening position to the localization position of the sound image indicated by the sound source localization signal.

9. The sound reproduction apparatus according to claim 1, wherein the sound source position parameter calculating unit is configured to calculate an angle that indicates a direction of arrival of the sound source localization signal with respect to the listening position, among the parameters that indicate a localization position of the sound image indicated by the sound source localization signal, using energy of a signal component of the sound source localization signal and an angle that indicates the direction of arrival.

10. The sound reproduction apparatus according to claim 1, wherein the sound source position parameter calculating unit is configured to calculate a distance from the listening position to the localization position of the sound image indicated by the sound source localization signal, among the parameters that indicate a localization position of the sound image indicated by the sound source localization signal, using energy of a signal component of the sound source localization signal.

11. A sound reproduction apparatus which reproduces input audio signals using front speakers and ear speakers, the input audio signals being multi-channel and assumed to be reproduced using corresponding speakers placed in predetermined standard positions in an acoustic space, the front speakers being placed in the standard positions in front with respect to a listening position, and the ear speakers being placed near the listening position and in positions different from any of the standard positions, the sound reproduction apparatus comprising:

a non-transitory memory configured to store a program; and a hardware processor configured to execute the program and cause the sound reproduction apparatus to operate as:

a sound source localization estimating unit configured to estimate, from the input audio signals, whether or not a sound image is localized in the acoustic space when it is assumed that the input audio signals are reproduced using the speakers placed in the standard positions;

a sound source signal separating unit configured to calculate, when the sound source localization estimating unit estimates that the sound image is localized, a sound source localization signal that is a signal indicating the sound image that is localized;

a sound source position parameter calculating unit configured to calculate, from the sound source localization signal, a parameter that indicates a localization position of the sound image indicated by the sound source localization signal; and a reproduction signal generating unit configured to distribute the sound source localization signal to the front speakers and the ear speakers using the parameter that indicates the localization position, and to generate a reproduction signal to be supplied to the front speakers and the ear speakers, wherein the sound source localization estimating unit is configured to (i) estimate whether or not a sound image indicated by a first sound source localization signal is localized, using the input audio signals of two channels which make a pair among the input audio signals, (ii) estimate whether or not a sound image indicated by a second sound source localization signal is localized, using the input audio signals of two channels which make another pair among the input audio signals, (iii) estimate whether or not a sound image indicated by a third sound source localization signal is localized, using the first sound source localization signal and the second sound source localization signal, and (iv) estimate that the third sound source localization signal is a sound source localization signal indicating a sound image that is localized by all of the input audio signals, and the sound source signal separating unit is configured to minimize a square sum of an error between (i) a sum signal of the first sound source localization signal and the second sound source localization signal and (ii) one of the first sound source localization signal and the second sound source localization signal, to calculate the signal component of the third sound source localization signal, which corresponds to the one of the sound source localization signals, and to separate the calculated signal component from the corresponding one of the first sound source localization signal and the second sound source localization signal.

12. The sound reproduction apparatus according to claim 11, wherein the sound source localization estimating unit is configured to (i) estimate whether or not the sound image indicated by the first sound source localization signal is localized, using input audio signals of two channels assigned to, among the standard positions, right and left in front with respect to the listening position, (ii) estimate whether or not the sound image indicated by the second sound source localization signal is localized, using input audio signals of two channels assigned to, among the standard positions, right and left in back with respect to the listening position, and (iii) estimate whether or not the sound image indicated by the third sound source localization signal is localized, using the first sound source localization signal and the second sound source localization signal.

13. The sound reproduction apparatus according to claim 11, wherein the sound source localization estimating unit is configured to (i) calculate a correlation coefficient between the first sound source localization signal and the second sound source localization signal, for each frame which is used as a unit and is provided at a predetermined time interval, and (ii) estimate, when the correlation coefficient is larger than a predetermined threshold, that the sound image indicated by the third sound source localization signal is localized using the first sound source localization signal and the second sound source localization signal.

* * * * *